US005971850A

United States Patent [19]

Liverance

[11] Patent Number: 5,971,850

[45] **Date of Patent: *Oct. 26, 1999**

[54] GAME APPARATUS HAVING INCENTIVE PRODUCING MEANS

[75] Inventor: Howard L. Liverance, Ann Arbor, Mich.

[73] Assignee: Richard Spademan, Sacramento, Calif.

[ * ] Notice: This patent is subject to a terminal disclaimer.

[21] Appl. No.: 08/342,458

[22] Filed: Nov. 18, 1994

Related U.S. Application Data

[62] Division of application No. 07/874,479, Apr. 24, 1992, Pat. No. 5,370,399, which is a continuation of application No. 07/355,805, May 19, 1989, abandoned, which is a continuation of application No. 06/834,184, Feb. 26, 1986, which is a continuation-in-part of application No. 06/661,275, Oct. 16, 1984, abandoned, which is a continuation-in-part of application No. 06/320,830, Nov. 12, 1981, abandoned.

[51] Int. Cl.[6] ..... A63F 9/22

[52] U.S. Cl. ..... 463/23; 463/7; 273/143 R; 473/569

[58] Field of Search ..... 463/16, 17, 18, 463/20, 23, 52, 7; 273/143 R, DIG. 28; 473/569

[56] References Cited

U.S. PATENT DOCUMENTS

| | | | |
|---|---|---|---|
| 2,826,828 | 3/1958 | Hamilton | 463/23 |
| 4,015,846 | 4/1977 | Runte et al. | 463/23 |
| 4,114,882 | 9/1978 | Mau | 463/23 |
| 4,366,960 | 1/1983 | Bromley et al. | 463/8 |
| 5,370,399 | 12/1994 | Liverance | 463/23 |

*Primary Examiner*—Jessica Harrison
*Assistant Examiner*—James Schaaf
*Attorney, Agent, or Firm*—Townsend and Townsend and Crew

[57] ABSTRACT

An incentive producing apparatus having a symbol displaying device, a player actuated device for changing the symbols on the displaying device, an accounting device for recording the changes in symbol displays caused by the operation of the player actuated device, and a processor responsive to the manner in which the player operates the device in such a way that the device responds to player input in the form of response time relative to the time of day or calendar time in order to adjust the operation of the apparatus to automatically, continually, proportionally, and subtly increase or decrease the difficulty of operation to maintain the incentive of the player to continue to operate the apparatus. The apparatus can be in the form of a slot machine game, an arcade game, a video action game or an education game. An embodiment of each type of such apparatus is disclosed.

7 Claims, 24 Drawing Sheets

FIG. 15

| | | | | | |
|---|---|---|---|---|---|
| 1-1 | 100000 | 2-1 | 100000 | 3-1 | 100000 |
| 1-2 | 010000 | 2-2 | 000001 | 3-2 | 000010 |
| 1-3 | 001000 | 2-3 | 000010 | 3-3 | 000100 |
| 1-4 | 010000 | 2-4 | 000001 | 3-4 | 001000 |
| 1-5 | 000100 | 2-5 | 001000 | 3-5 | 000010 |
| 1-6 | 010000 | 2-6 | 000001 | 3-6 | 000100 |
| 1-7 | 000010 | 2-7 | 000010 | 3-7 | 000010 |
| 1-8 | 010000 | 2-8 | 000001 | 3-8 | 000100 |
| REEL NUM1 → 1-9 | 000100 | 2-9 | 000010 | 3-9 | 010000 |
| 1-10 | 010000 | 2-10 | 000001 | 3-10 | 000010 |
| 1-11 | 000001 | 2-11 | 010000 | 3-11 | 000100 |
| 1-12 | 000100 | 2-12 | 000010 | REEL NUM3 → 3-12 | 000010 |
| 1-13 | 010000 | 2-13 | 000001 | 3-13 | 000100 |
| 1-14 | 001000 | 2-14 | 001000 | 3-14 | 000010 |
| 1-15 | 010000 | 2-15 | 000001 | 3-15 | 000001 |
| 1-16 | 000100 | 2-16 | 000010 | 3-16 | 000010 |
| 1-17 | 010000 | 2-17 | 000001 | 3-17 | 000100 |
| 1-18 | 000100 | 2-18 | 000100 | 3-18 | 001000 |
| 1-19 | 010000 | REEL NUM2 → 2-19 | 000001 | 3-19 | 000010 |
| 1-20 | 000100 | 2-20 | 010000 | 3-20 | 000100 |
| 1-21 | 010000 | 2-21 | 000001 | 3-21 | 000010 |
| 1-22 | 000100 | 2-22 | 000010 | 3-22 | 000100 |

| | | | |
|---|---|---|---|
| SEVEN | 100000 | PLUM | 000100 |
| BELL | 010000 | ORANGE | 000010 |
| CHERRY | 001000 | BAR | 000001 |

FIG.16

| | | |
|---|---|---|
| | 0 0 1 0 0 0 | CHERRY |
| COMBINATION 26 | 0 0 1 0 0 0 | CHERRY |
| | 1 1 1 1 1 1 | DON'T CARE |
| | 0 0 0 1 0 1 | REWARD(5) |
| | 0 0 1 0 0 0 | CHERRY |
| COMBINATION 27 | 1 1 1 1 1 1 | DON'T CARE |
| | 0 0 1 0 0 0 | CHERRY |
| | 0 0 0 1 0 1 | REWARD(5) |
| | 1 1 1 1 1 1 | DON'T CARE |
| COMBINATION 28 | 0 0 1 0 0 0 | CHERRY |
| | 0 0 1 0 0 0 | CHERRY |
| | 0 0 0 1 0 1 | REWARD(5) |
| | 0 0 1 0 0 0 | CHERRY |
| COMBINATION29 | 1 1 1 1 1 1 | DON'T CARE |
| | 1 1 1 1 1 1 | DON'T CARE |
| | 0 0 0 0 1 0 | REWARD(2) |
| | 0 0 0 0 1 0 | ORANGE |
| COMBINATION30 | 0 0 0 0 1 0 | ORANGE |
| | 0 0 0 0 1 0 | ORANGE |
| | 0 1 0 1 0 0 | REWARD(20) |

| | | | |
|---|---|---|---|
| SEVEN | 1 0 0 0 0 0 | PLUM | 0 0 0 1 0 0 |
| BELL | 0 1 0 0 0 0 | ORANGE | 0 0 0 0 1 0 |
| CHERRY | 0 0 1 0 0 0 | BAR | 0 0 0 0 0 1 |

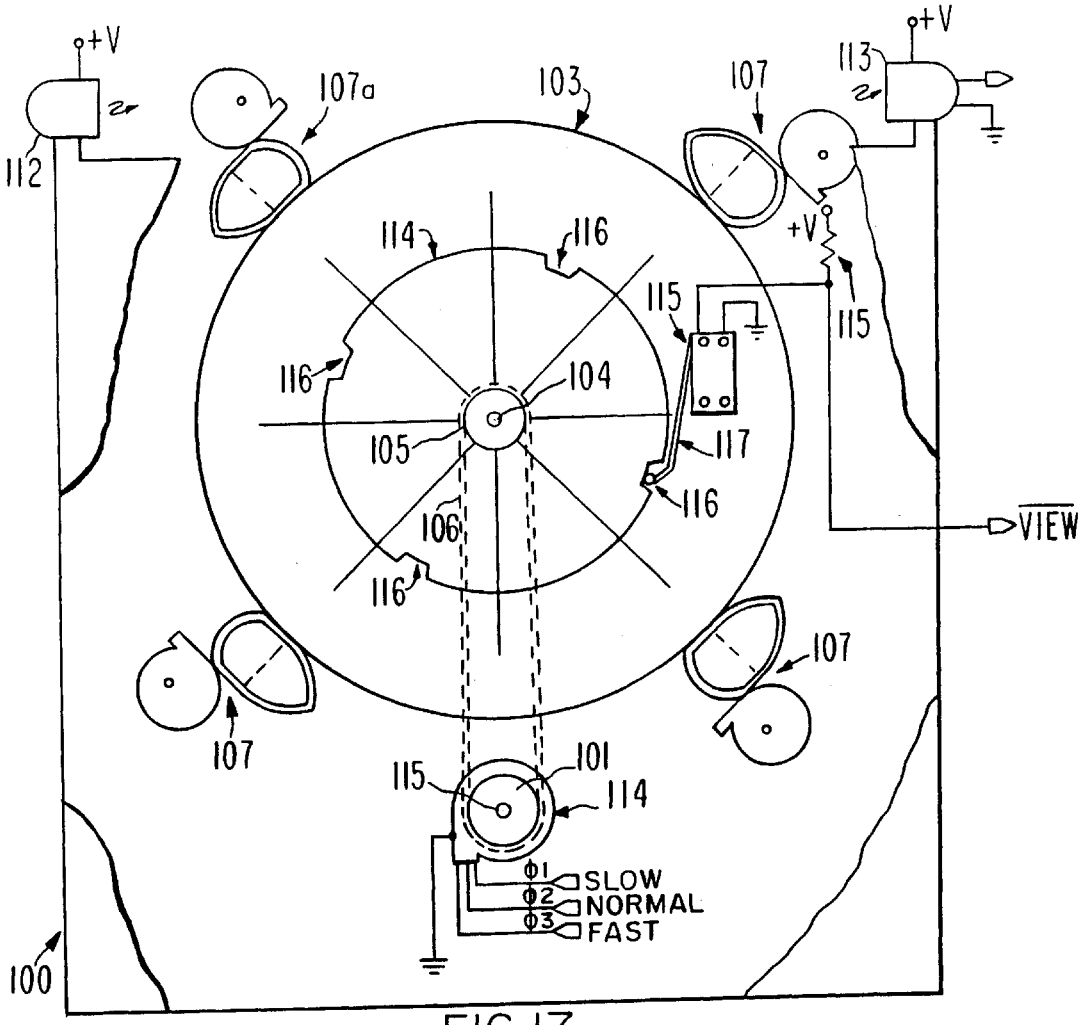
FIG.17
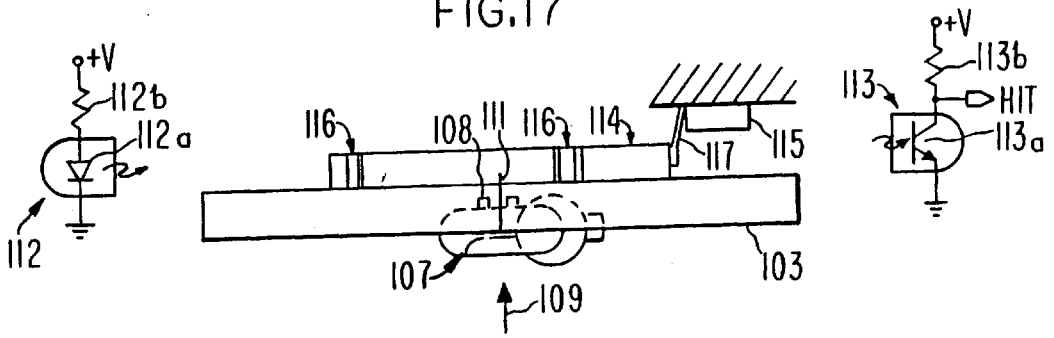
FIG.18
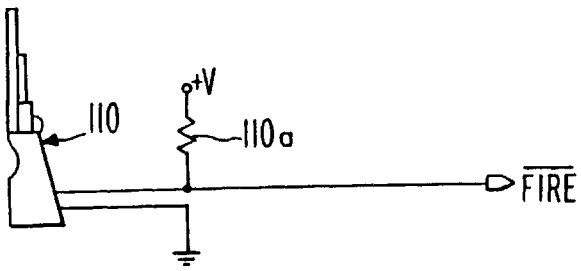

GAME APPARATUS HAVING INCENTIVE PRODUCING MEANS

This is a division of application Ser. No. 07/874,479, filed Apr. 24, 1992, now U.S. Pat. No. 5,370,399; which was a Rule 60 Continuation of 07/355,805, filed May 19, 1989, now abandoned; which was a continuation of Ser. No. 06/834,184, filed Feb. 26, 1986; which was a CIP of Ser. No. 06/661,275, filed Oct. 16, 1984, now abandoned; which was a CIP of Ser. No. 06/320,830, filed Nov. 12, 1981, now abandoned.

BACKGROUND OF THE INVENTION

Heretofore, in amusement devices, such as slot machine games, efforts have been made to create incentive producing means by the use of an apparatus that provides various choices or options that are made available to the player. In one such slot machine game, disclosed in U.S. Pat. No. 2,579,241, the player is allowed to hold or retain one or more of the previously displayed symbols with the possibility of creating a match on the next spin and thereby creating a winning condition. However, if the player is not successful in this blind judgment, he may quickly loss incentive to operate the game and discontinue play.

In more recent game devices, a player is allowed to build up a winning combination by progressively holding winning symbols on several reels until a desirable combination appears. A game device of this type is disclosed in U.S. Pat. No. 4,037,845. Another disclosure, U.S. Pat. No. 4,184,683, teaches that the player can select a particular symbol at which one of the drums of a slot machine game will stop with the hope of having the other drums of the slot machine game stop on a matching symbol. Yet another game device, disclosed in U.S. Pat. No. 4,191,377, allows the player to advance one of the reels one symbol position in an attempt to create a winning combination.

Electronic game apparatus using a displaying means such as a video screen have been disclosed that allow the player to control the symbols on the displaying device. Mau in U.S. Pat. No. 4,114,882 discloses an electronic game in which means is provided for the player to vary the velocity of a ball image and to move the ball image in an erratic fashion to increase the challenge and incentive to continue play. Thompson in U.S. Pat. No. 3,715,811 refers a player of an educational game to any one of a number of branching routines according to the response of the player to certain presented educational material. The effect of this device is to determine the instructional level of the player by noting the response to certain educational materials which may provide continued interest in operating the device.

The intent of all of these devices is to incorporate options into the function of a game to maintain interest in the game. It is apparent that maintaining player interest in play, and thereby incentive to play, is viewed as a definite need in the game apparatus industry. In each case, the changes in game operation occur in response to player operation of the device. If the outcome is successful due to those changes, it is possible that the player will be inspired to continue play. If, however, the outcome is unsuccessful, the player is likely to become discouraged and discontinue playing because his unsuccessful combination was partially a product of his failure to pick or hold the right symbol.

SUMMARY OF THE INVENTION

The present invention relates to slot machines and other machines for playing various types of computer and arcade games wherein a determinable parameter in the player's behavior can be sensed by the apparatus and used to modify machine operation in such a way as to stimulate the interest of the player in continuing to play the machine. For example, in a slot machine game, determination of the score and/or response time in inserting tokens or coins into the machine, or in pulling the actuating handle of the machine, can be used to change the amount of reward given by the machine so as to maintain or increase the motivation of player to operate the machine. In a video or arcade game, determination, for example, of the response time required by a player to actuate an electronic trigger and/or the store of the player can be used to determine reward and to change the speed at which the game operates in order to optimize the challenge, and thereby maximize the interest that players of widely varying skill levels have in continuing to play the game. If the game is too easy, good players will soon lose interest. It follows that if the game is too hard, poor players will become discouraged and also loss interest. In an education game, the ability level of the player can be determined by now quickly and accurately he answers questions such that the difficulty of subsequent questions can be adjusted to a reasonably challenging level.

The apparatus of the present invention avoids the basic problem inherent in previous devices of this type which attempt to increase suspense, and thereby interest, in games. Unlike conventional games, the type of apparatus disclosed herein has the capability to automatically, continually, proportionally, and subtly adjust to the player'level of performance, i.e., score and response time. By monitoring player score and response time to machine stimulus, it is possible to adjust the difficulty of the game to a level suitable to the player thereby maintaining his interest for substantially longer periods of time than with a conventional game. Other variables can also be monitored and used in the proper determination of the optimum difficulty level of the game for the current player. Some examples of these other variables are time of day, calendar time, location in the game room, or even the random effects of weather. Some of these variables have been incorporated into the embodiments described herein, for example. The primary function of the present invention is, therefore, to provide sensing and feedback capabilities to a game device which will monitor the effect of the device on a player's motivation based on his response time, score, or other variables. This information is then used to change the operation of the device in a manner such that the player perceives a continuing level of success in play. The device accomplishes this by decreasing, equaling, or increasing the difficulty level of the game to maintain the incentive of the player to continue to play the game. The heart of the device is provided by a special processor which accomplishes these functions automatically, continually, proportionally, and subtly.

The information gathered by the above mentioned processor is used to adjust the operating characteristics of the machine of the present invention to optimize a player's enjoyment or interest in playing the game. This determination is made dynamically in response to changes in player behavioral characteristics to keep the player sufficiently stimulated to continue to play the machine. This state of the machine in which this condition of the player occurs will be henceforth referred to as the IDEAL OPERATING LEVEL of the machine.

Slot machine games, arcade games, video games, and education games have similarities such that the present invention may be discussed generally as it relates to all four types. In each case, a displaying device with a means of visual stimulus is provided, although the stimulus need not be restricted to visual and can be aural, tactile, or any combination thereof. It is understood that these other types of stimuli can be applied separately or in conjunction with visual stimulus. In the case of the slot machine game, the visual stimulus is provided by the commonly used rotating wheels having a number of different observable symbols on their outer peripheral faces. It is likewise understood that this invention is usable in combination with slot machine video displays known per se. In the video game or education game, the visual stimulus is generally provided by a color video display screen, such as an ordinary television or a chromatic cathode ray tube or color monitor. In the arcade game, stimulus is provided by a series of mechanically moving figures or images.

An operating device having an actuatable control member is provided in each types of machine of the present invention for the player to operate a device such as a switch, lever or knob for the actuation and play of the machine, whereby the player can initiate and/or control operation of the game. Each machine also has a processor and an accounting device having a reward payment device for computing a score and determining response time to provide a reward based on the outcome of the game. A machine that pays out tokens, such as a slot machine game, uses a coin hopper for this purpose. The arcade game, reflex action video game or education game will generally compute a reward and provide the player with additional plays of the game based on the degree of performance in playing a previous game. The present invention as it relates to the slot machine game, the arcade game, the video game and the education game will be discussed henceforth.

The present invention can be incorporated into a conventional slot machine game. This machine typically includes three or more reels having various different symbols or indicia on their peripheral faces. The angular position of each reel relative to a predetermined reference can be sensed electronically by the controlling processor. Each reel can also be stopped in a selected position or zone by the use of solenoids under control of the processor. The machine also incorporates, as is common, a coin acceptor device, and a coin hopper wherein coins may be stored and paid out under control of the processor. The unique nature of this invention is characterized by the use of a special timing circuit which operates with the processor to determine the player's behavior in the response time or frequency with which he or she inserts a coin or pulls the actuation handle. This timing circuit can also be used to determine other variable parameters such as time of day, calendar time such as day of the week, season of the year and holiday periods which may effect a player's incentive to play. All of these parameters are used by the processor in determining the magnitude of the incentive of the player to continue to operate the machine. In the video reflex action and arcade games, this INCENTIVE VALUE can be determined on the basis of player response time and score, as well as time of day, calendar time, or other parameters. In an education game, reward level determined from the accuracy of correctly answered questions within a certain time period can be used. The processor then decides if the current player's incentive to continue playing has increased or decreased since the last play. If it has been determined that the player's incentive level has decreased, the machine pays out a slightly higher reward this play to entice the player to continue to operate the machine. It makes this determination of the player's incentive based on a compilation of the aforementioned parameters and forms a value representing the incentive of the player. If the INCENTIVE VALUE is lower this play than in the previous play, the player's incentive is said to have lessened. Conversely, if the new INCENTIVE VALUE is higher than in the last play, the player's incentive is said to have increased and he will probably continue to operate the game.

The processor of the current invention converts the INCENTIVE VALUE into a factor which represents the IDEAL REWARD. The IDEAL REWARD is defined as the reward necessary for the player to continue to operate the game with the same or greater interest than in the previous play. Thus, in this way, the player's incentive to continue is determined and maintained. The aforesaid INCENTIVE VALUE, therefore, determines the IDEAL OPERATING LEVEL of the system.

In the slot machine game, the INCENTIVE VALUE determined for the current player is compared to a table of previously generated random numbers representing the symbols which may appear on the reels. Each combination of symbols has a reward associated with it which may change depending upon the number of coins that have been inserted into the machine. It is understood that there may be some combinations of symbols for which there is no reward. The closest match between the determined IDEAL REWARD and the available rewards listed in the table of random numbers is found and the reels are stopped at positions corresponding to the random number whose reward was chosen. The reward that is paid out is the one which most closely matches the incentive requirements of the player as determined by the processor from the score, response time, time of day, calendar time, and/or other parameters, to maintain the IDEAL OPERATING LEVEL. This establishes what will be termed the PRACTICAL OPERATING LEVEL of the machine. The PRACTICAL OPERATING LEVEL is defined as the closest the processor can come to functioning at the IDEAL OPERATING LEVEL.

Synonymous to the random number table in the slot machine game is an operating speed or other alterable parameter table in the video game or arcade game, or a question and subject difficulty table in the education game. Based on the IDEAL OPERATING LEVEL determined from player response time and/or score, etc., the table is scanned to provide the closest match between player incentive requirements and practical machine operation. This value is used to modify the difficulty of the game to bring the PRACTICAL OPERATING LEVEL close to the IDEAL OPERATING LEVEL. The system is automatically and continually monitoring for any changes in player behavioral patterns to permit and to cause changes in the aforesaid incentive value as deemed necessary to maintain the player's incentive to continue to play the game.

As stated previously, these changes are made, at the discretion of said processor, automatically, continually, proportionally, and subtly. Automatically, as it applies to this invention, may be defined as follows: The self-regulation of the device to change game operational difficulty in response to a given player input. Continually, as it applies to this invention, may be defined as follows: The change in game operational difficulty that may occur during each REWARD-DISPLAYING period. This is each period during which the machine displays the current reward for the player to see. Operational difficulty may also change during each REWARD PERIOD. This is each period during which the machine may calculate a reward for the current player, regardless of whether or not it is displayed for the player to see. Changes in operational difficulty may also occur during each DISPLAYING PERIOD. This is each period during which the display may be changed since the last visible display. Any new change in a display, such as a new reel position in the slot machine game or a new cursor or graphics image position in the video related games, constitutes what will be termed a DISPLAYING PERIOD. Proportionally, as it applies to this invention, may be defined as follow: The reward which may be calculated for each player based on measurements of the player's score and/or response time for a particular time of day or calendar time, each of which are the readily measurable parameters in the slot machine game, the video game, the arcade game, and the education game embodiments, respectively, as described herein. Any given change in one or more of the abovementioned parameters may result in an equivalent change in machine operation. The game may get more or less difficult in proportion to the reward which is calculated for each player. The amount that the game becomes more difficult is proportional to the amount that it becomes less difficult, given an equivalent change in a characteristic of the player. Also, any increase in game difficulty is permitted to occur within the same period as any decrease in game difficulty. In this way, during any period of operation, the machine may increase or decrease game difficulty to match the needs of the player. Subtly, as it applies to this invention, may be defined as follow: Changes in machine operation that may occur in such a way that the player is not directly aware that the game is becoming more or less difficult. Also, reward information may not be presented to the player in such a way as to be detrimental to the incentive of the player to continue to play the game.

The characteristics of machine operation of the present invention are detailed above so as to clearly distinguish the concept of this invention from others which teach away from the disclosure of this invention. One such patent is Bromley U.S. Pat. No. 4,366,960. Bromley teaches that the player must choose a skill level with which to play the game. This disclosure automatically determines the player's skill level based on a measurement of the player's score and/or response time during a particular time. Bromley teaches that a downward adjustment in difficulty level is made only intermittently, which is counter to the continual nature of this disclosure. Bromley does not become more or less difficult in proportion to score or reward. The amount that it becomes more difficult is not proportional to the amount it becomes less difficult. The game can not become less difficult within the same period as it can become more difficult. The difficulty level of the Bromley machine is limited to a small range of discrete values which increase the probability that a player will perceive a change in machine operation when one occurs. A low score or reward in the Bromley machine is presented to the player of low performance which may result in loss of incentive to play the game.

The primary object of the present invention is to provide apparatus and method for playing a game in which the interest of the player is sustained by automatically and continually monitoring his or her behavior and by carefully modifying machine operation to maintain conditions that the player considers desirable to continue to operate the game.

IN THE DRAWINGS

FIG. 1 is a schematic view of the present invention as applied to a conventional slot machine game;

FIG. 1*a* is a schematic view of the present invention as applied to a conventional arcade game;

FIG. 1*b* is a schematic view of the present invention as applied to a conventional video game;

FIG. 1*c* is a schematic view of the present invention as applied to an educational game;

FIG. 2 is a more detailed, schematic view of a portion of the slot machine game of FIG. 1 showing three rotatable reels bearing certain symbols which, when properly aligned, indicate a reward payable to the player of the slot machine game;

FIG. 3 is a schematic view of the control circuitry of the slot machine, a flowchart showing the incentive value calculation associated with the slot machine game;

FIG. 4 is a flowchart showing the incentive value conversion and corresponding random number selection associated with the slot machine game;

FIG. 5 is a flowchart showing the reel stopping and reward payout actions of the slot machine game;

FIG. 6 is a block diagram showing the random number and associated reward buffer memory configuration for each reward value;

FIG. 7 is a block diagram showing a typical bircuitry associated with a number of solenoids of the slot machine game;

FIG. 8 is a general, overall system flowchart, showing the basic operation and function of the slot machine game of the present invention;

FIG. 9 is a random number generation flow chart which shows the way in which the program recycles continually as long as no activity is in progress at the slot machine game;

FIG. 10 is a flowchart of the random number storage and reward calculation portion of the slot machine game;

FIG. 11 is a flowchart showing the incentive value calculation associated with the slot machine game;

FIG. 12 is a flowchart showing the incentive value conversion and corresponding random number selection associated with the slot machine game;

FIG. 13 is a flowchart showing the reel stopping and reward payout actions of the slot machine game;

FIG. 14 is a block diagram showing the random number and associated reward buffer memory configuration for each reward value;

FIG. 15 is a block diagram showing a typical buffer representing the order of symbols as they appear on each of the reels of the slot machine game;

FIG. 16 is a block diagram showing a section of the buffer representing the win table thereof;

FIG. 17 is a schematic view of a typical arcade machine for playing a shooting game, showing the mechanical parts of the machine;

FIG. 18 is a schematic, top plan view of the machine of FIG. 17;

FIG. 19 is a schematic view of the circuit configuration for the arcade game machine of FIGS. 17 and 18;

FIG. 20 is a perspective view of a machine for playing a video game, illustrating a processor, a video display, and a player operating device such as a paddle or 'joy stick';

FIG. 21 is a flowchart showing the operation of the program which controls the operation of the machine of FIG. 20;

FIG. 22 is a flowchart of the target control subroutine for the machine of FIG. 20;

FIG. 23 and 24 are flowcharts of a pair of utility routines for target control and for simulating a bullet firing;

FIG. 25 is a part of a flowchart for a routine for use in playing an education game using the machine of FIG. 20; and FIG. 26 is a continuation of the flowchart of FIG. 23 for the play of the education game.

DESCRIPTION OF THE DRAWINGS

The apparatus or machine of the present invention in the form of a slot machine game is broadly denoted by the numeral 10 and is illustrated in its simplest form in FIG. 1. Apparatus 10 includes a symbol displaying device 10*a* in the form of side-by-side rotating wheels having a number of different symbols on the outer peripheral faces of the reels. The symbols are alignable with each other in zones to present a particular result from the playing of the slot machine game. Many new slot machine games incorporate video displays rather than the familiar mechanical reels. It is understood that the means for displaying the above-mentioned symbols is one form of the invention and that this invention could easily be applied to slot machine games with video displays by someone who is skilled in the art.

Apparatus 10 further includes an accounting device comprising a token receiving and payout device which includes a token or coin counting means 10*b*, a response and calendar time counter 10*c*, and a player operating device 10*d* having an actuatable control member, such as a push button, handle, or lever which is operated by the player when the apparatus is to be actuated for causing rotation of the reels. The apparatus further includes a processor 10*e* that is responsive to player input through the aforementioned actuation device.

The processor is coupled by a data bus to the other components of the apparatus. Through the data bus, the processor monitors a number of variable parameters such as the duration between button pushes or lever pulls, and the time of day and week when the apparatus is being operated. The processor uses the information to determine a player's incentive to continue to play the game. Based upon the information received, the processor selectively picks a game outcome or reward from a group of randomly generated numbers representing the symbols to appear on the reels of the displaying device 10*a*. The reels are then stopped at the positions which display the symbols represented by the selected game outcome. In this way, rather than a totally random game outcome as in other slot machine games, the processor has influenced the game outcome based on information on the player's incentive to play, which was received from the player's controls and other parameters. Then, the accounting device 10*b* is actuated, and a reward is paid to the player based on the arrangement of symbols displayed by the reels. The method for determining which symbols should be displayed, and their corresponding reward paid out, is based on a determination of player incentive characteristics which are obtained by monitoring time counter 10*c* and player actuating device 10*d*. If player incentive wanes, as determined by processor 10*e*, the apparatus responds by increasing the reward payment in order to thereby increase the player's incentive to play the game.

Figure 1:
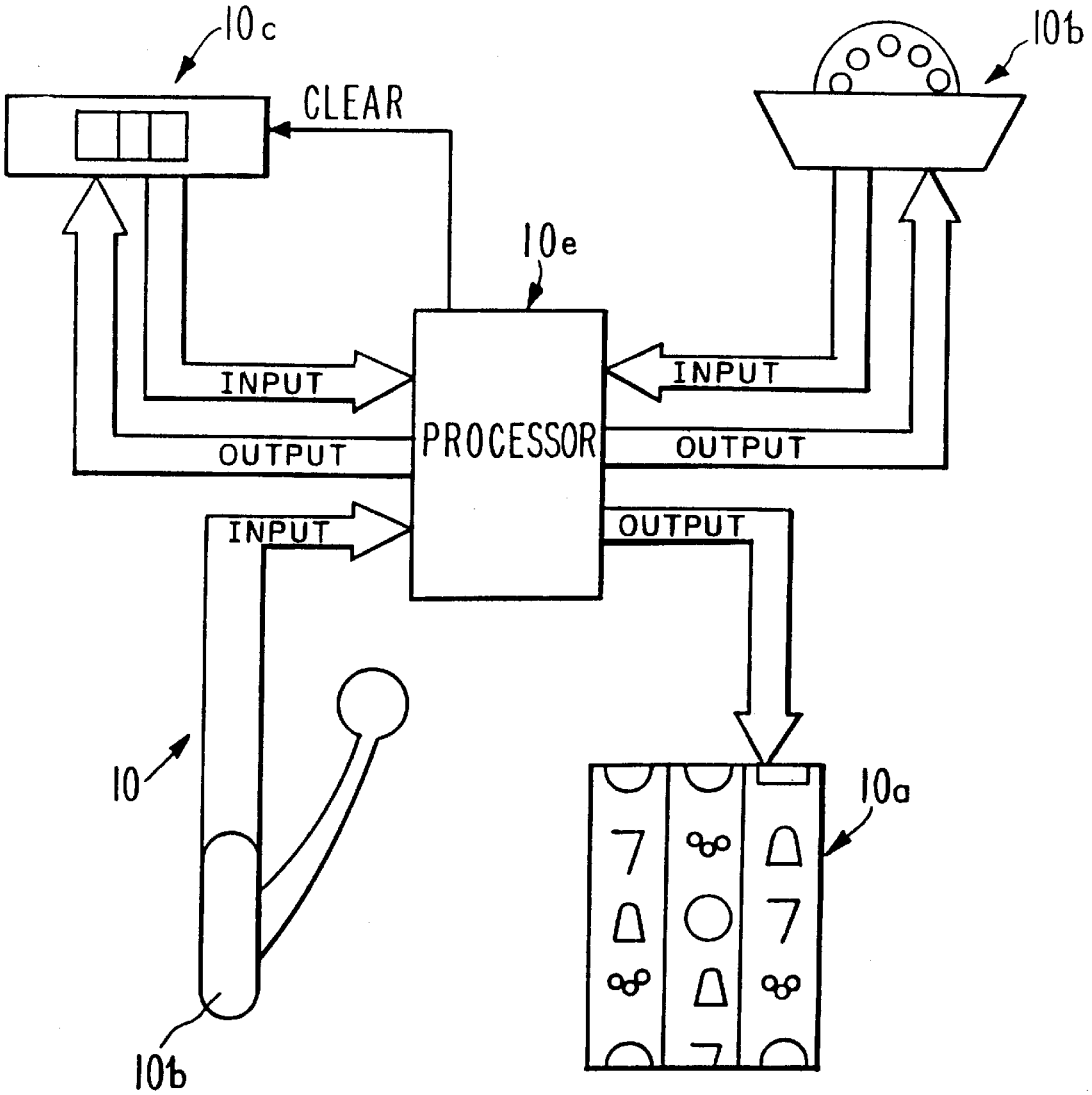
Figure 1A:
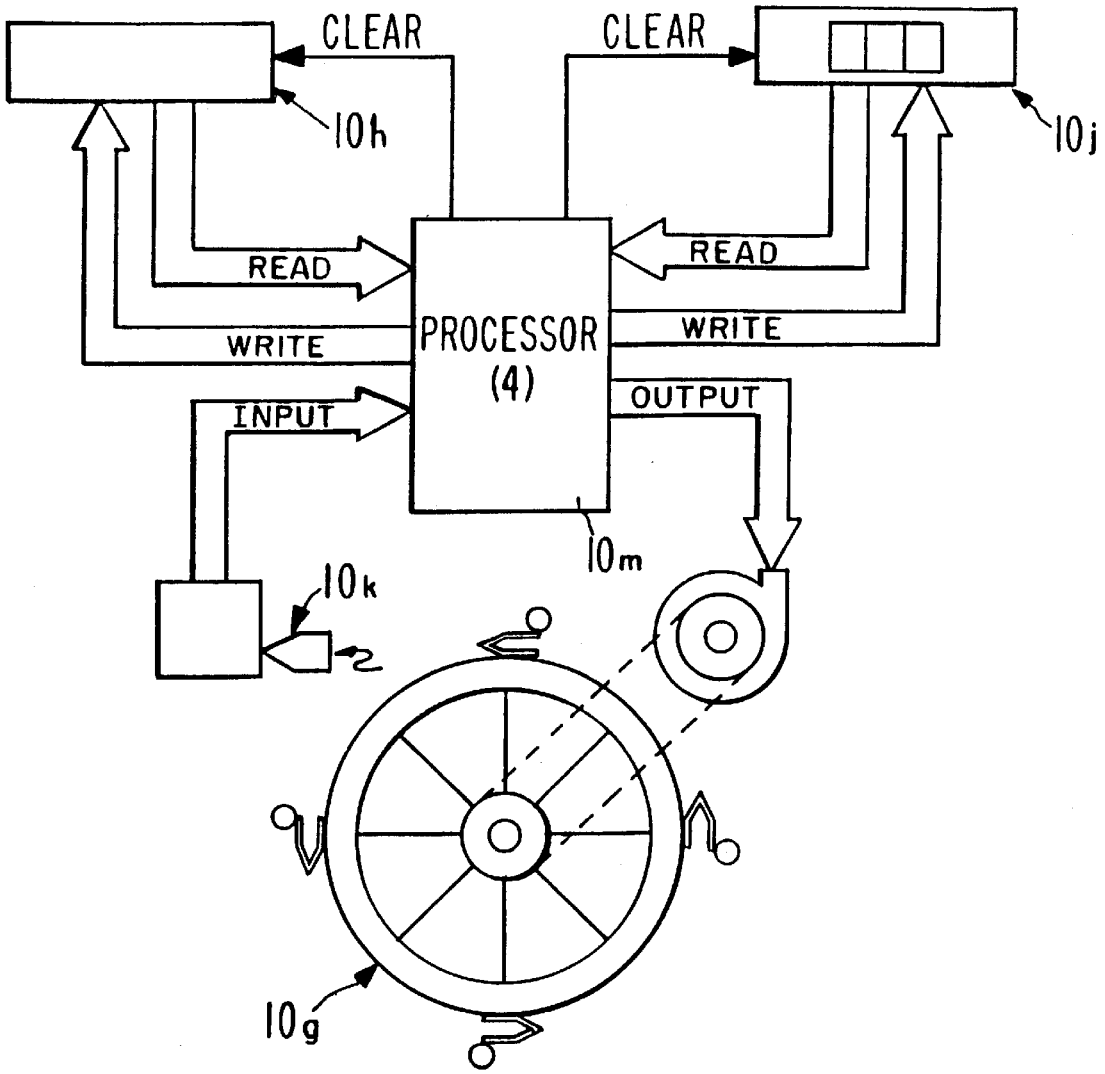

The apparatus or machine of the present invention can be in the form of an arcade game as shown in FIG. 1*a*. Games of this type use a displaying device mounted on a support structure, such as mechanically moving wheels, rails or drums which have symbols thereon. Examples range from targets on a rotating wheel that must be shot with a gun, to a projection type auto race in which the image of a continuous racetrack on a rotating drum is projected onto a screen on which the automobile is to be maneuvered through the curves of the track by turning a mock steering wheel. To operate the game, the player may first pay an attendant or insert a coin into the machine. Then, based upon the score and response time of the player during a particular time of day and calendar time of the play, a reward is generated, such as a prize or an additional play of the game.

In FIG. 1*a*, a symbol displaying device 10*g* is in the form of a mechanically rotating wheel having targets on the outer periphery thereof. An accounting device comprised of an ideal and actual reward counting means 10*j* provides for accounting. A response and calendar time counting means 10*h* is also provided. A player operating device 10*k*, including an actuatable control member such as a gun which shoots projectiles, which can be bullets or a light beam, is provided to direct projectiles against the targets on the wheel as it rotates. A processor 10*m*, which is coupled to each of the above-mentioned devices, is responsive to a number of inputs in that is uses a counter to determine an EXPECTED REWARD for the game. This may include the player's response time to the symbols and time of day and calendar time of game operation, and uses that information to change the EXPECTED REWARD for the game. If the player's ACTUAL REWARD based on hits, as tallied by the accounting device, falls below the EXPECTED REWARD as computed by the processor, then wheel rotation is slowed slightly to increase the player's opportunity for an improved reward. With an improved reward, the player perceives he is doing better and will therefore have an increased incentive to continue to play the game.

Conversely, if the player's ACTUAL REWARD based on hits exceeds the EXPECTED REWARD computed by the processor, the rotational speed of the wheel is increased to increase the challenge of the game. In each case, player input has been sensed by the processor through the actuating device and the symbols are changed by the processor to increase player incentive to play the game.

Figure 1B:
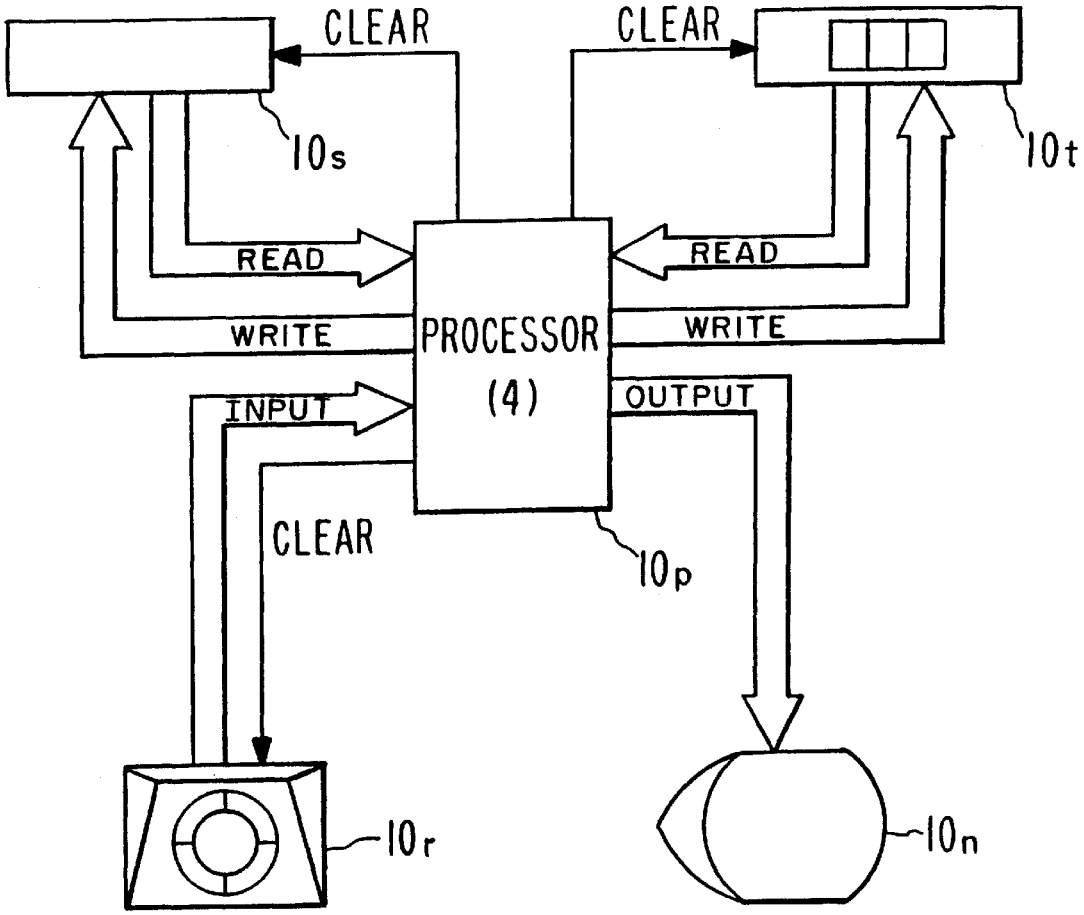

FIG. 1*b* shows the apparatus of the present invention as used in a video game. This type of game is characterized by a video screen containing graphic symbols whose positions or configurations are altered by a player operating a device having an actuatable control member such as a push button, lever, dial, or other electronic input device. To operate the game, the player may insert one or more coins into the machine. The object of the game is to control at least one symbol in a predefined manner. This may include shooting down a spacecraft with a missile, or accurately guiding a racecar through an obstacle course. In any case, as with the play of a slot machine game, the player is attempting to achieve an optimal game outcome based upon his operation of the actuatable control member. There is a vast assortment of these types of games on the market and it is understood that this invention is not particular to the one being described herein, but may be applied to each one in a way particular to the predefined manner in which the game is to be played. The tasks involved in playing a video game may require a certain degree of skill to accomplish successfully. The relative success in accomplishing these tasks is generally measured by a cumulative point system. Certain types of games allow a cash or token payout or additional plays of the game if a certain minimum reward is achieved.

For purposes of illustration, FIG. 1*b* shows a symbol displaying device 10*n* coupled to a processor 10*p*, the latter being coupled to a player operating device 10*r*. An accounting device, having a reward payment means in the form of additional plays or similar reward, is embodied by score counting means 10*t* and coupled to the processor 10*p*. Response and calendar time counting means 10*s* is also coupled to processor 10*p*. The processor is responsive to a number of inputs in that it makes a determination of player response time and score of the player through score counting means 10*t* and time counting means 10*s* and input from the player operating device 10*r*. It also determines the time of day and calendar time during which the machine is being operated. This information is used to selectively changes the symbols on displaying device 10*m*. If a less competent player is at the controls, the game may be slowed down, targets made bigger or controlled graphic symbols made more maneuverable, thereby changing the symbol display. These changes make the game easier and give the operator an opportunity to attain a higher reward as recorded by the accounting device. If the player perceives he is doing well, he has a greater incentive to continue to play the game than if he does poorly. Thus, the symbols have been changed by the processor based upon player input through the player operating device, which has an actuatable control member, to maintain the desired level of player incentive.

Figure 1C:
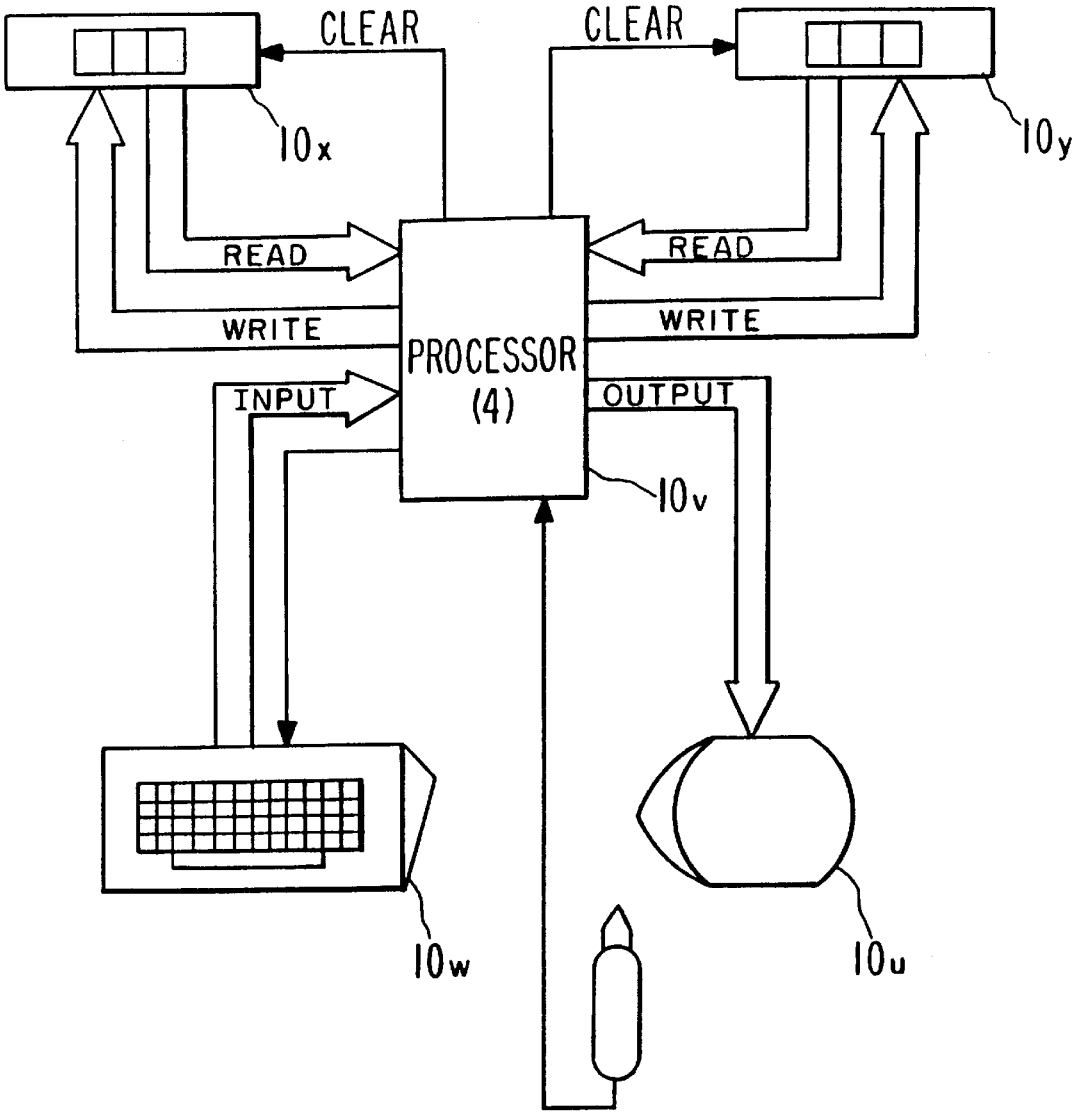

The apparatus of the present invention can be used in the form of an education game as shown in FIG. 1*c*. Such a game is of the type containing tutorial routines used by many computer systems for teaching history, mathematics, science, vocabulary, and other fields. Games of this type consist generally of a screen bearing tutorial symbols such as words, questions or categories and a selection of related answers from which the player must choose the correct one. Responses from the player are generally through keyboard entry, screen contact, or light pen input and the overall reward to the player is recorded by an accounting device having a grading means which is coupled to a processor.

FIG. 1*c* shows a displaying device 10*u* for displaying symbols, such as words, questions and answers. The displaying device is coupled to a processor 10*v*, the latter having an input from the player operating device comprising an actuatable control member 10*w* in the form of a keyboard. An accounting device in the form of a score and grade or reward determining means 10*y* and a response and calendar time counting means 10*x* are also coupled to the processor, the latter being responsive to player input in that it assesses the accuracy of the answers within a certain time frame and passes the information on to processor 10*v* to change the symbols on the display accordingly. If the questions or tasks seem too difficult for the player, the processor decreases the question difficulty level, thereby increasing the player's opportunity to correctly answer a higher percentage of the questions. Although there may be certain percentage of questions the player will answer wrong, the better the player feels he is doing, the more incentive he will have to continue to play the game. If the level of questioning is too easy, the processor increases question difficulty to maintain the challenge and thereby interest. In this way, the processor picks a competence level at which the player is comfortable, and automatically, continually, proportionally and subtly adjusts that level as the player's performance changes.

Figures 2, 3:
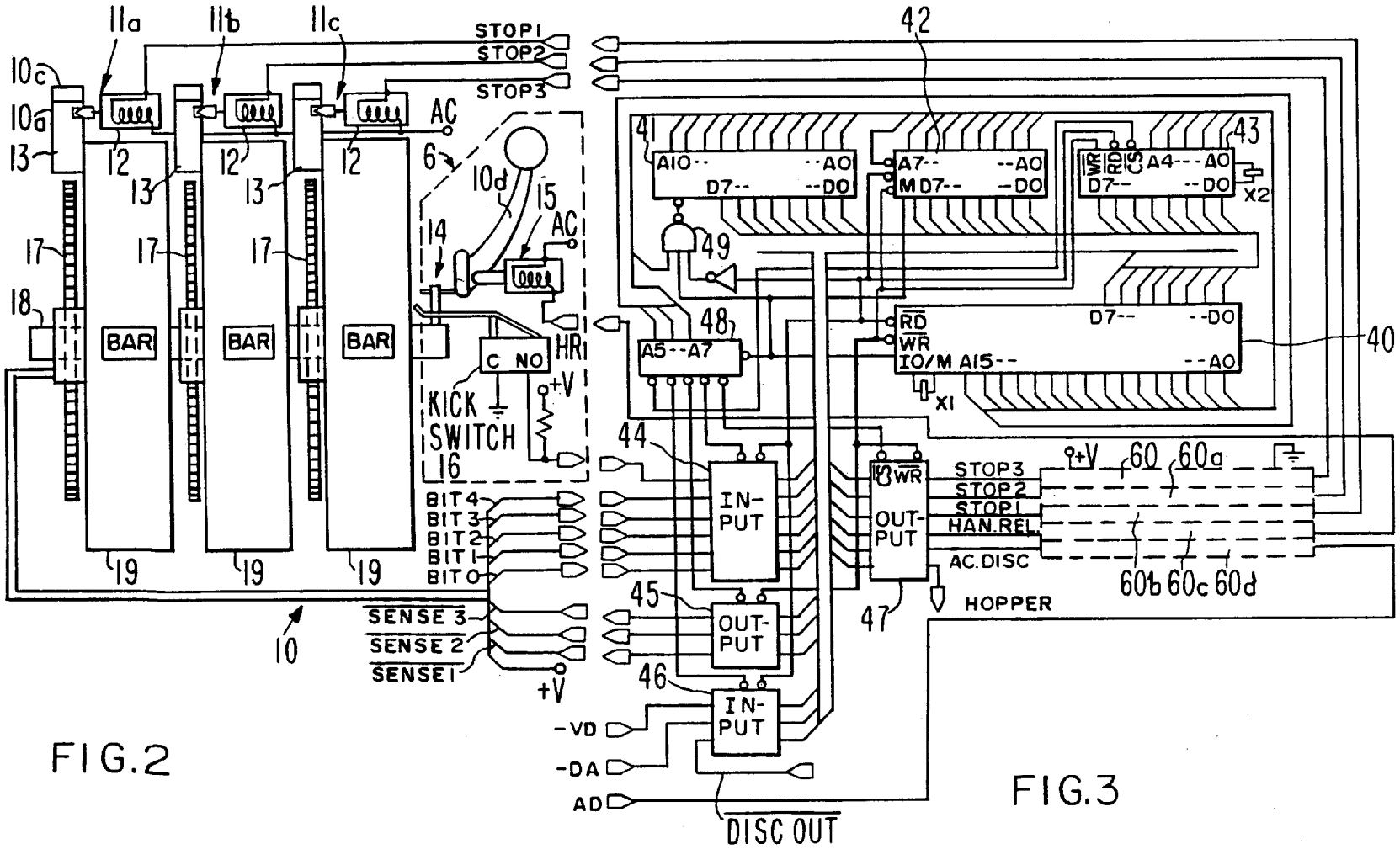

Apparatus 10 in the form of a slot machine game is shown in more detail in FIGS. 2–7. In FIG. 2, three reels 19 are rotatably mounted on a common shaft 18 and the reels have conventional reel stopping devices 11*a*, 11*b*, and 11*c* which include solenoids 12, spring bias ratchets 13, and notched disks 17 at the sides of respective reels and mounted on shaft 18 for rotation with the reels. A handle 10*d* is provided with kicking means 14 for imparting rotation motion to the three reels 19 about the common axis of shaft 18. The handle assembly denoted by the numeral 6 in FIG. 2 also contains locking means 15, and sensing means 16.

Figure 4:
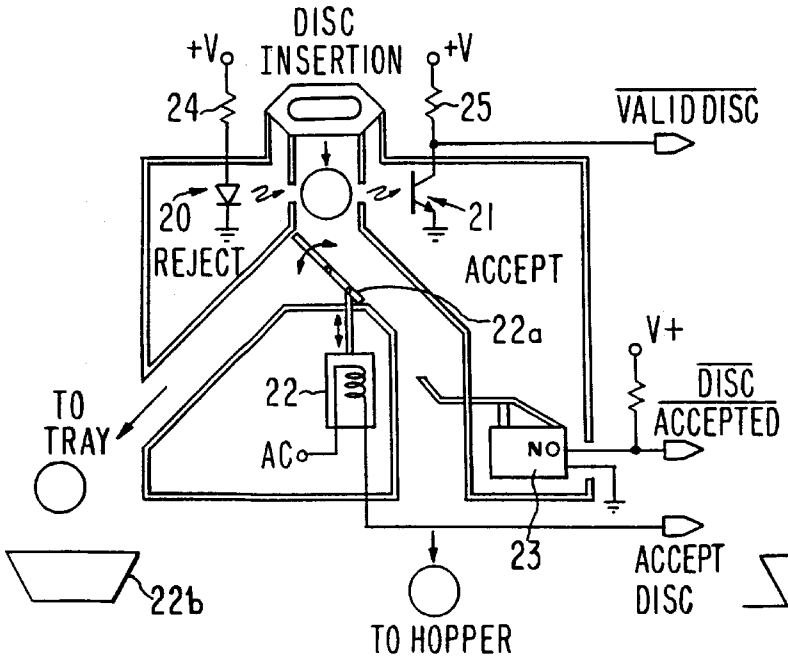

FIG. 4 shows a coin acceptor device such as one of those commonly known in the art. One such device is described in U.S. Pat. No. 3,998,309. Contained in the coin acceptor of FIG. 4 is a photoelectric valid-coin sensing means comprising a light source 20 and a light sensor 21; a disk acceptor solenoid 22 shown in the accept or activated position; and an accepted disk sensor switch 23 which indicates that a disk has indeed passed into the hopper located below the coin acceptor device.

Figure 5:
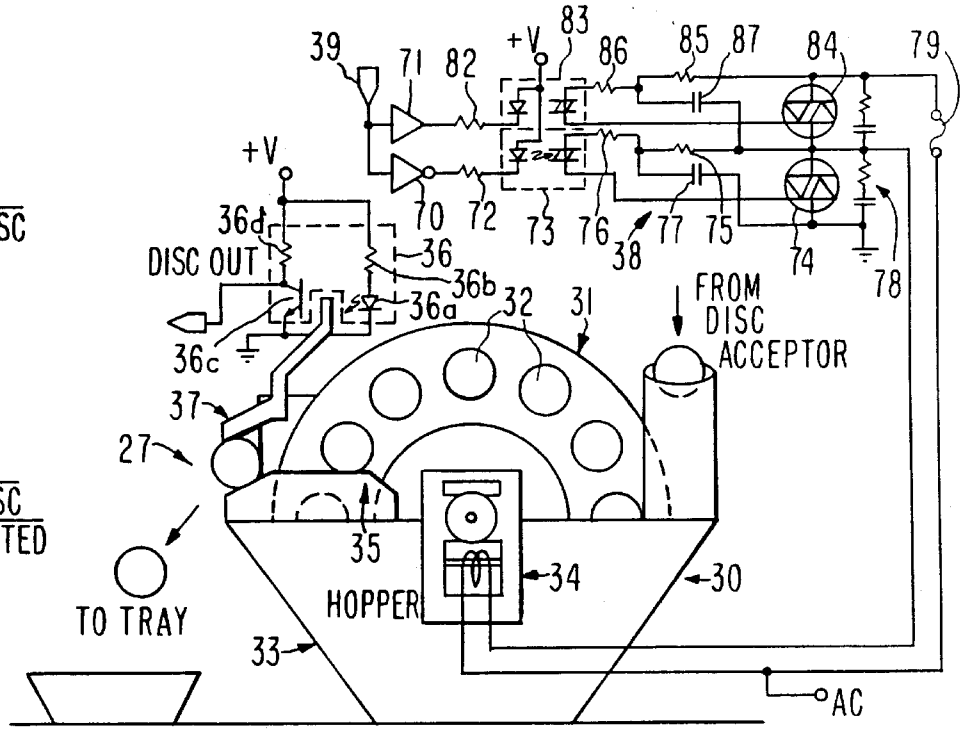

FIG. 5 illustrates a coin or token receiving, storage and payout device 27 of apparatus 10 with its associated circuitry. Section 27 includes a coin hopper 30 of the type typical of those generally known in the art such as the hopper described in U.S. Pat. No. 3,814,115. Hopper 30 includes a rotating wheel 31 with a plurality of circular coutouts 32 for carrying coin disks out of tub 33 when drive motor 34 has been actuated. As coin disks circulate, they are ejected by tab 35 and counted by disk sensor assembly generally denoted by the numeral 36 which is connected to hopper 30 by means of rocking lever 37. The hopper motor 34 is controlled through interface circuitry 38 which applies electrical power to the hopper motor 34 to cause it to rotate, or a breaking force to cause it to stop as will be set forth hereinafter.

FIG. 3, showing the control circuitry of apparatus 10, includes a microprocessor denoted by numeral 40. Program storage is contained in ROM 41, read/write memory is contained in RAM 42, the special timing circuit used for determining incentive is denoted by the numeral 43, and I/O (input and output) blocks 44, 45, 46, and 47 are used to interface the processor to the electromechanical parts of apparatus 10. Member 48 is a decoder used to select between I/O ports, and member 49 is a memory select decoder.

Figure 6:
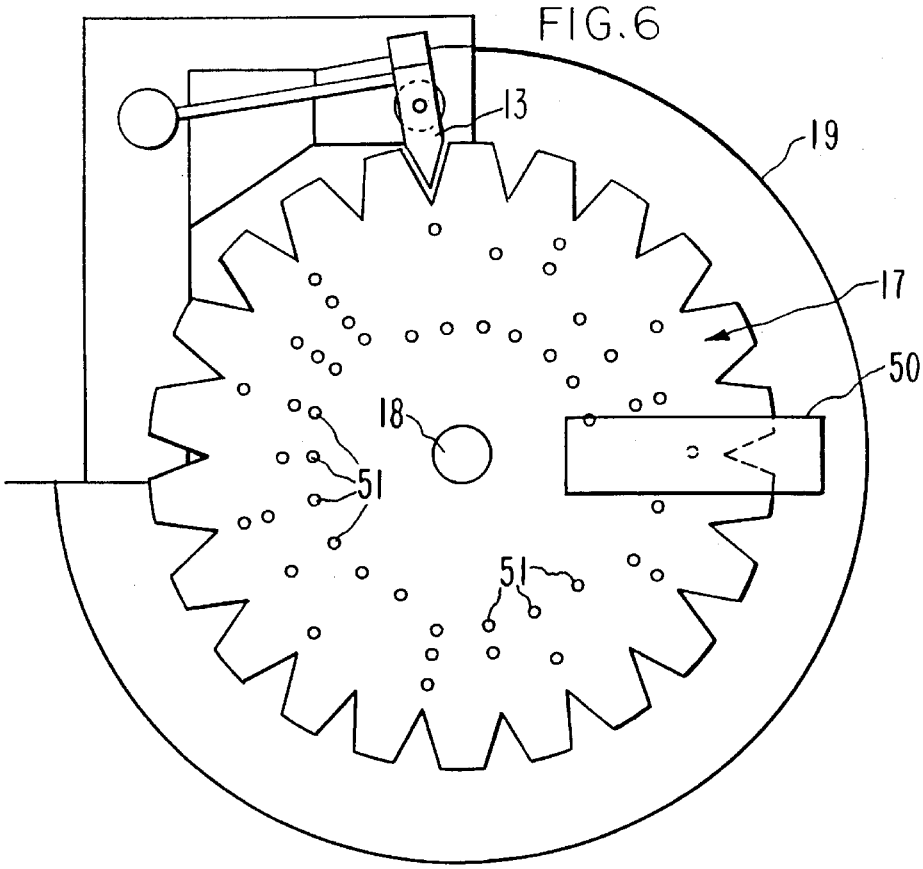
Figure 6A:
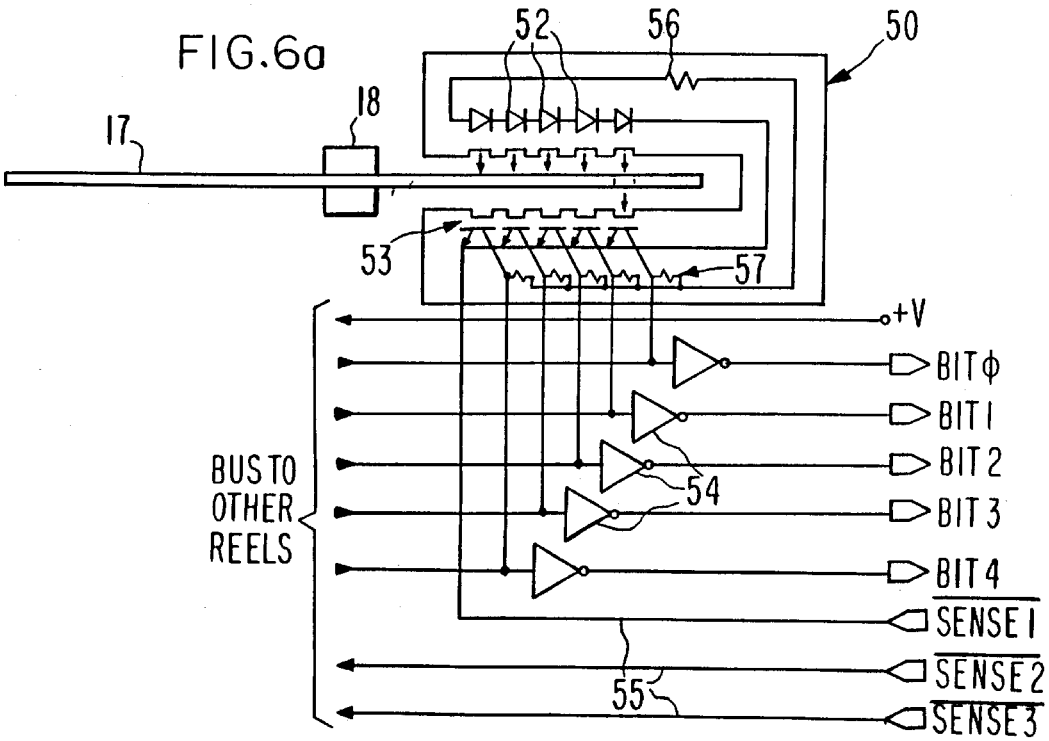

FIG. 6, showing a side view of one or reels 19, illustrates the way in which ratchet 13 is received within one of the notches of disk 17 to stop the rotation of the reel. Disk 17 contains a pattern of holes 51 arranged in a specific manner, such as in the manner shown in FIG. 6. These holes represent a binary pattern corresponding to a number of reel positions capable of being sensed by photoelectric sensing means 50 adjacent to disk 17. Contained in sensing means 50 is a series of light emitters 52 and a series of light receptors 53 on respective, opposed sides of disk 17 as shown in FIG. 6. A signal applied to the corresponding solenoid 12 (FIG. 2) causes the corresponding ratchet 13 to shift longitudinally and to be received within a notch on disk 17, thereby stopping the reel. This action aligns a given combination of holes 51 in the space between emitters 52 and receptors 53 which are buffered by drivers 54 to create a code designating the reel position. Each reel sensing means 50 is enabled by the appropriate sense lines 55 as shown in FIG. 6*a*.

Figure 7:
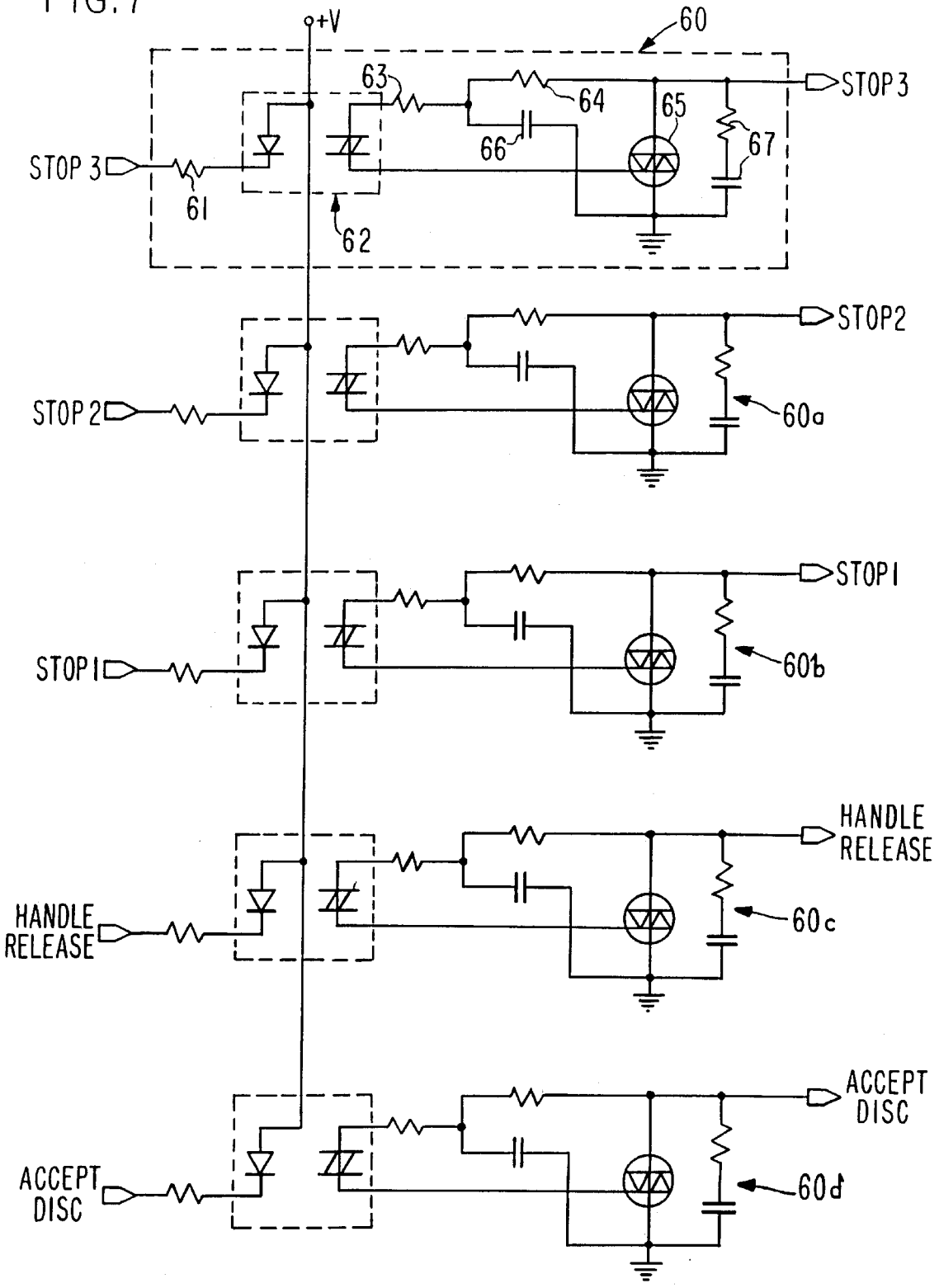

FIG. 7 shows the high voltage AC interface circuitry associated with the actuation of the solenoids of the system, including solenoids 12 associated with the reels 19. For example, one such circuit, denoted by the numeral 60, has a current limiting resistor 61, an opto-isolated silicon bilateral switch 62, current limiting and bias resistors 63 and 64, a Triac 65, despiking capacitor 66 and filter resistor-capacitor pair 67. Circuit 60 is associated with one of the solenoids 12, two of the other circuits 60*a* and 60*b* shown in FIG. 7 are associated with the other two solenoids for stopping the reels, and the remaining two circuits 60*c* and 60*d* shown in FIG. 7 are associated with the handle or lever release of solenoid 15 (FIG. 2) and the accept disk solenoid 22 (FIG. 4).

Figure 8:
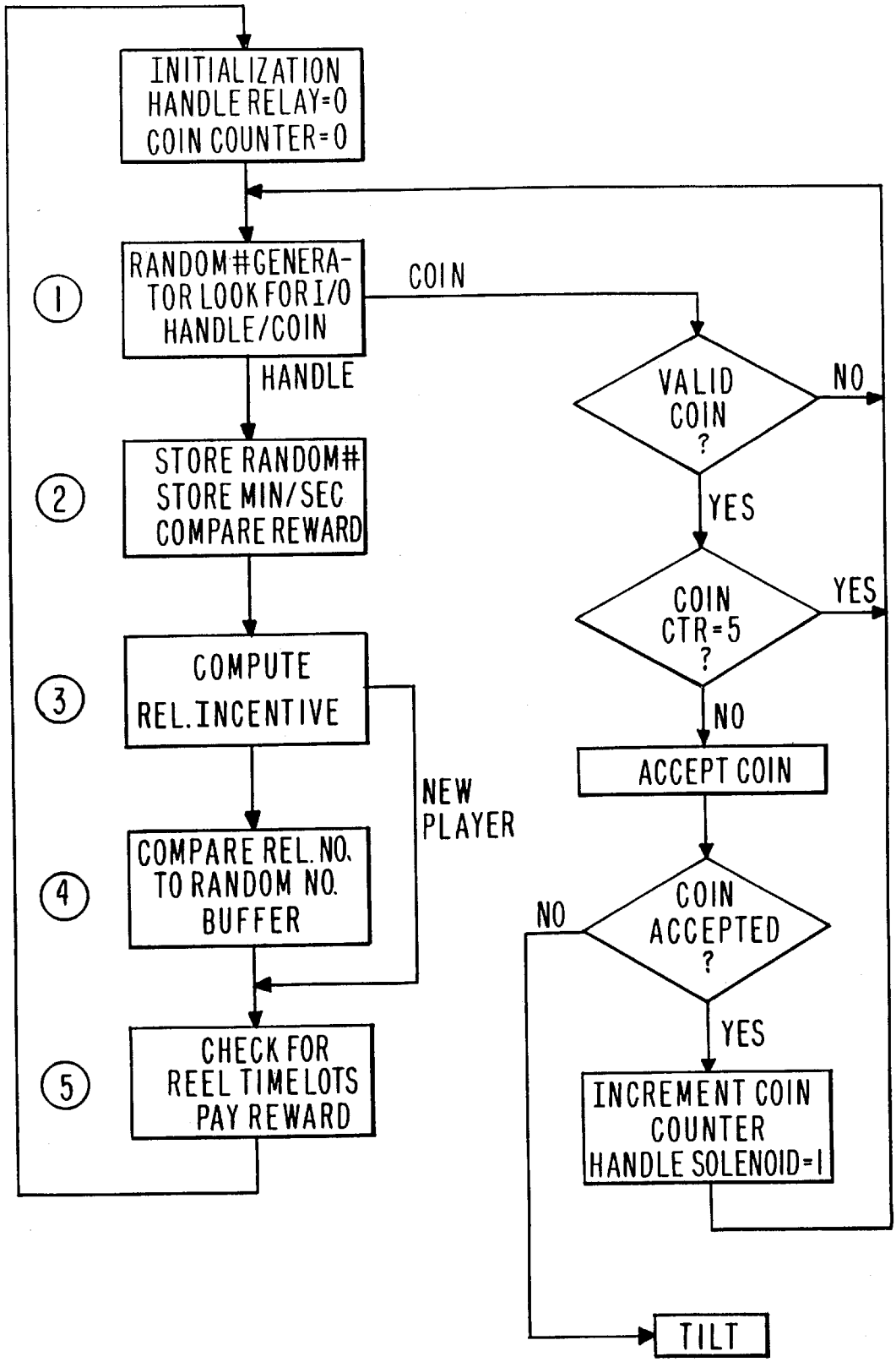
Figure 9:
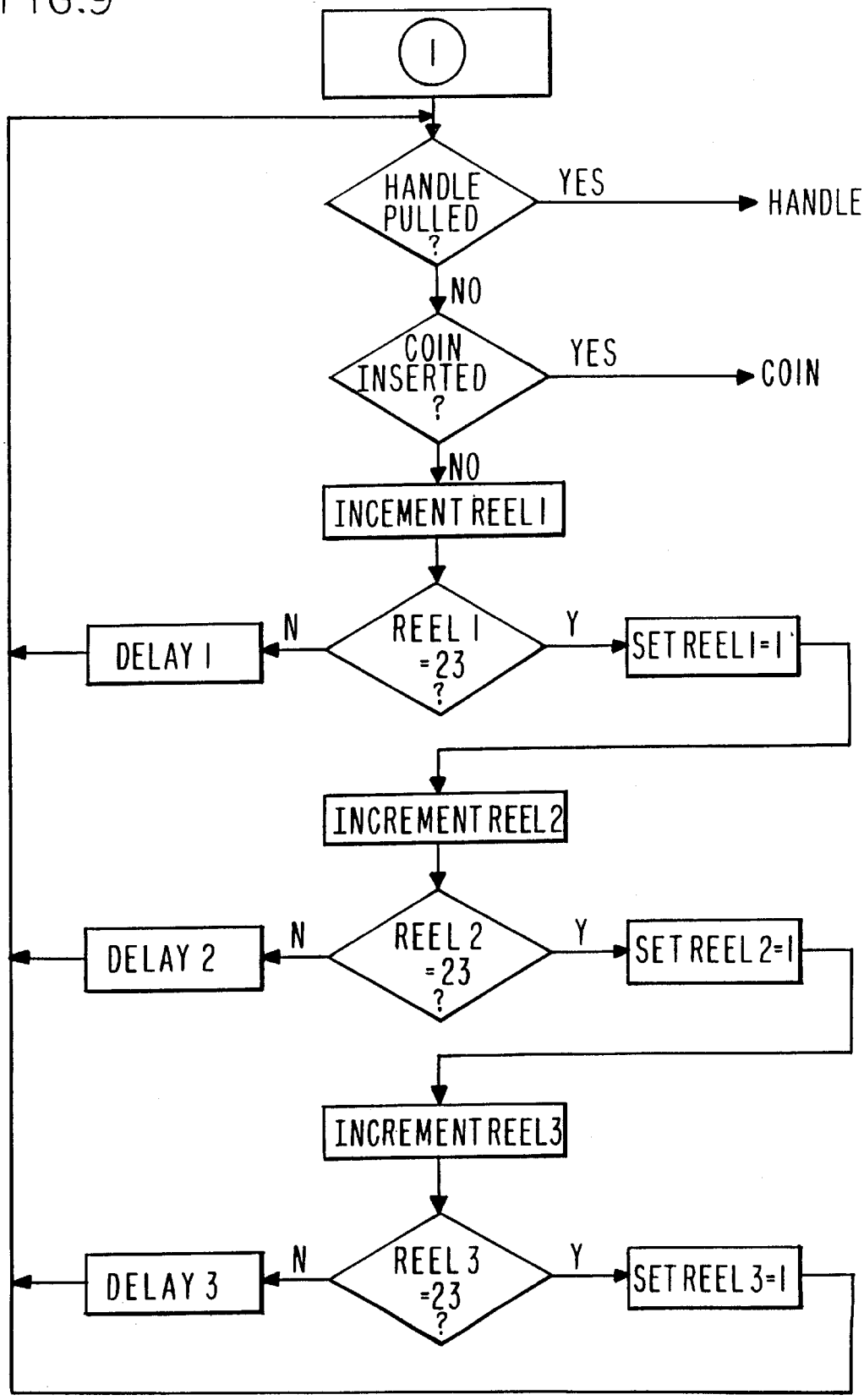
Figure 10:
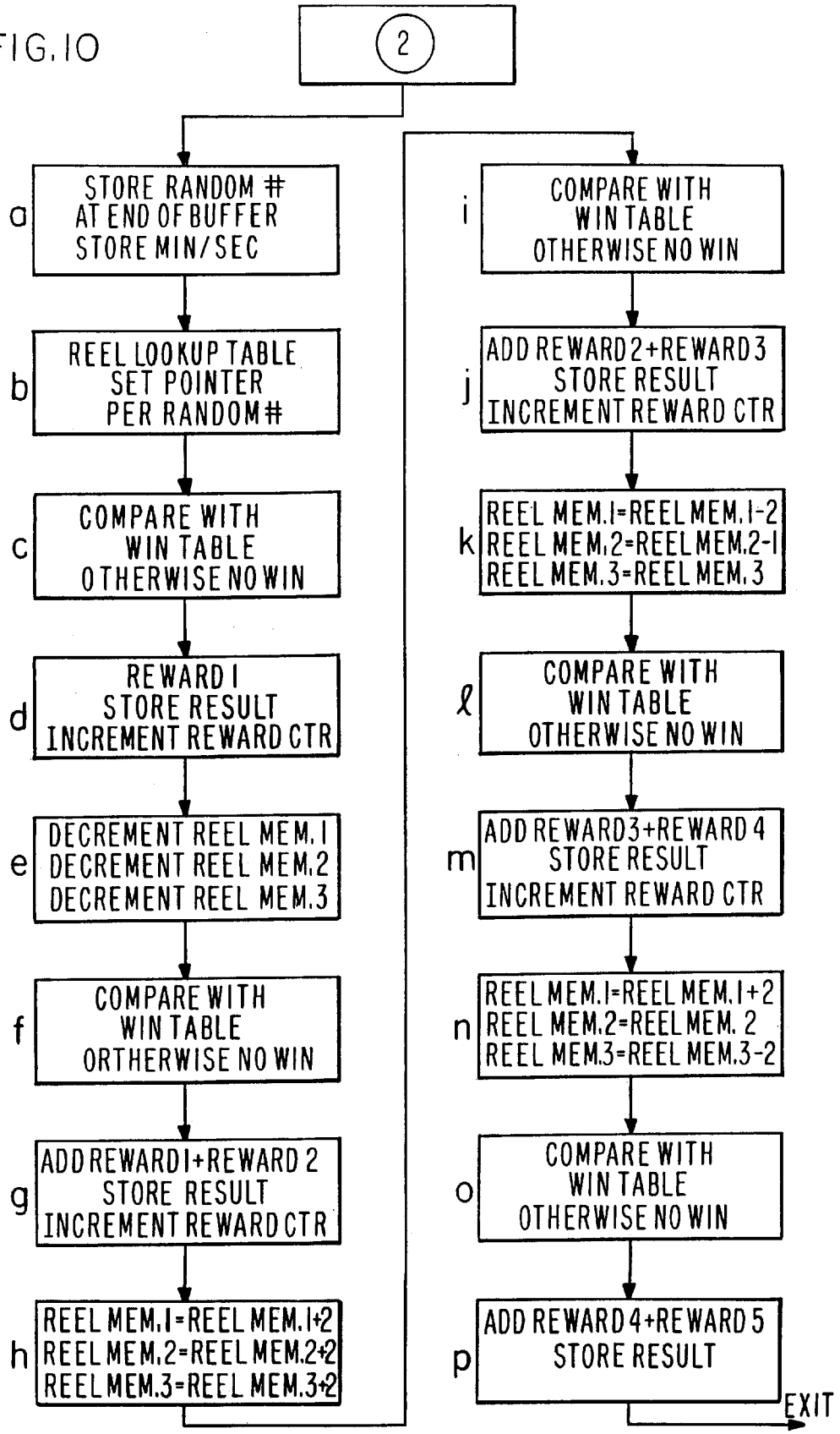

FIG. 8 is a flowchart showing the basic operation and function of apparatus 10. FIG. 9 is a flowchart which shows the way in which apparatus 10 checks for coin insertions or handle or lever pulls to indicate activity at the apparatus. FIG. 10 is a flowchart which relates to random number storage and reward calculation. The steps of this flowchart operate to save the current random number at the end of a buffer along with its calculated reward value.

Figure 11:
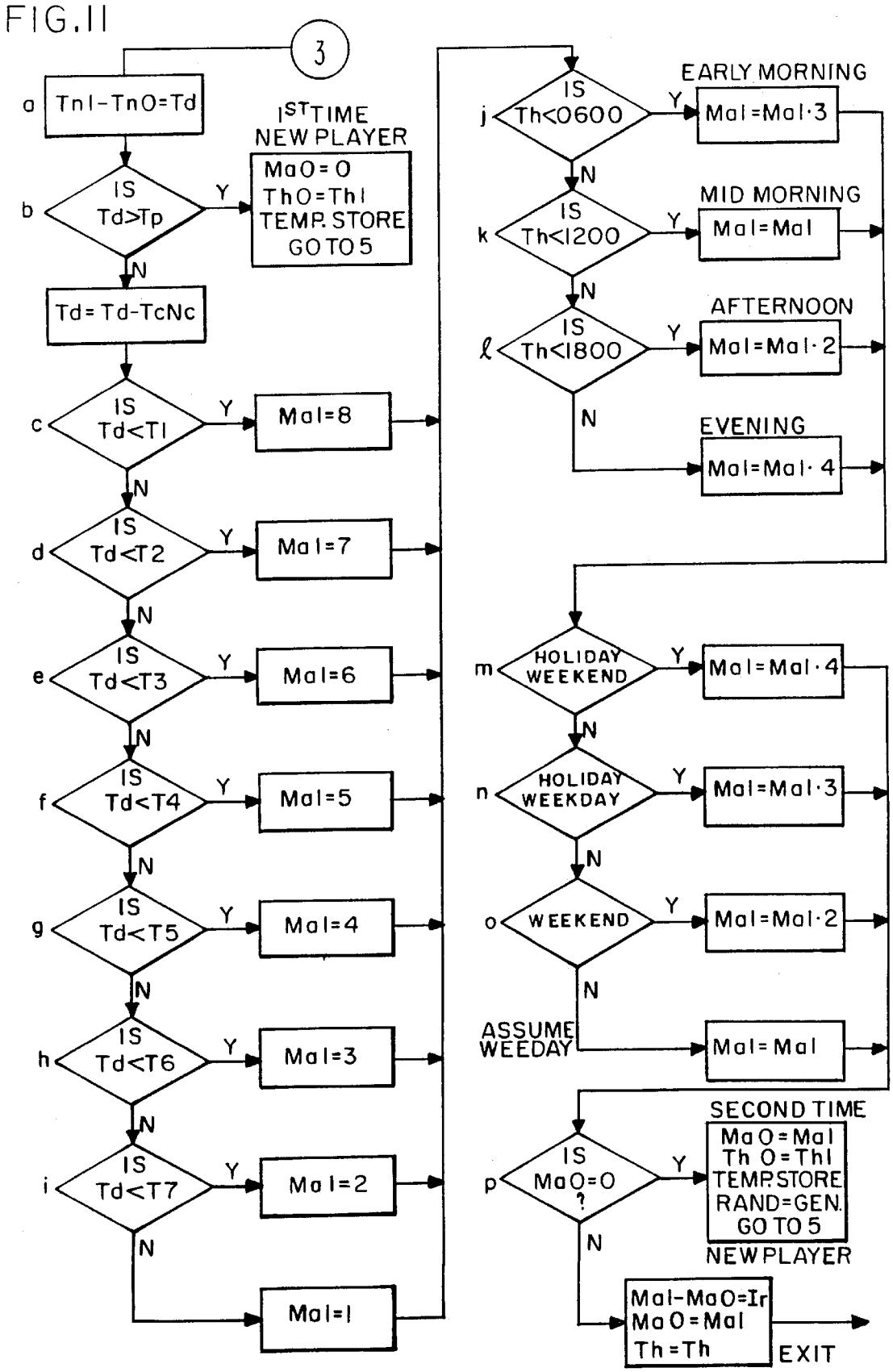

FIG. 11 is a flowchart which shows the operation of the apparatus as it determines a relative incentive value from player behavior characteristics. These characteristics are updated and stored in a memory location at each pull of the handle as indicated in the flowchart.

Figure 12:
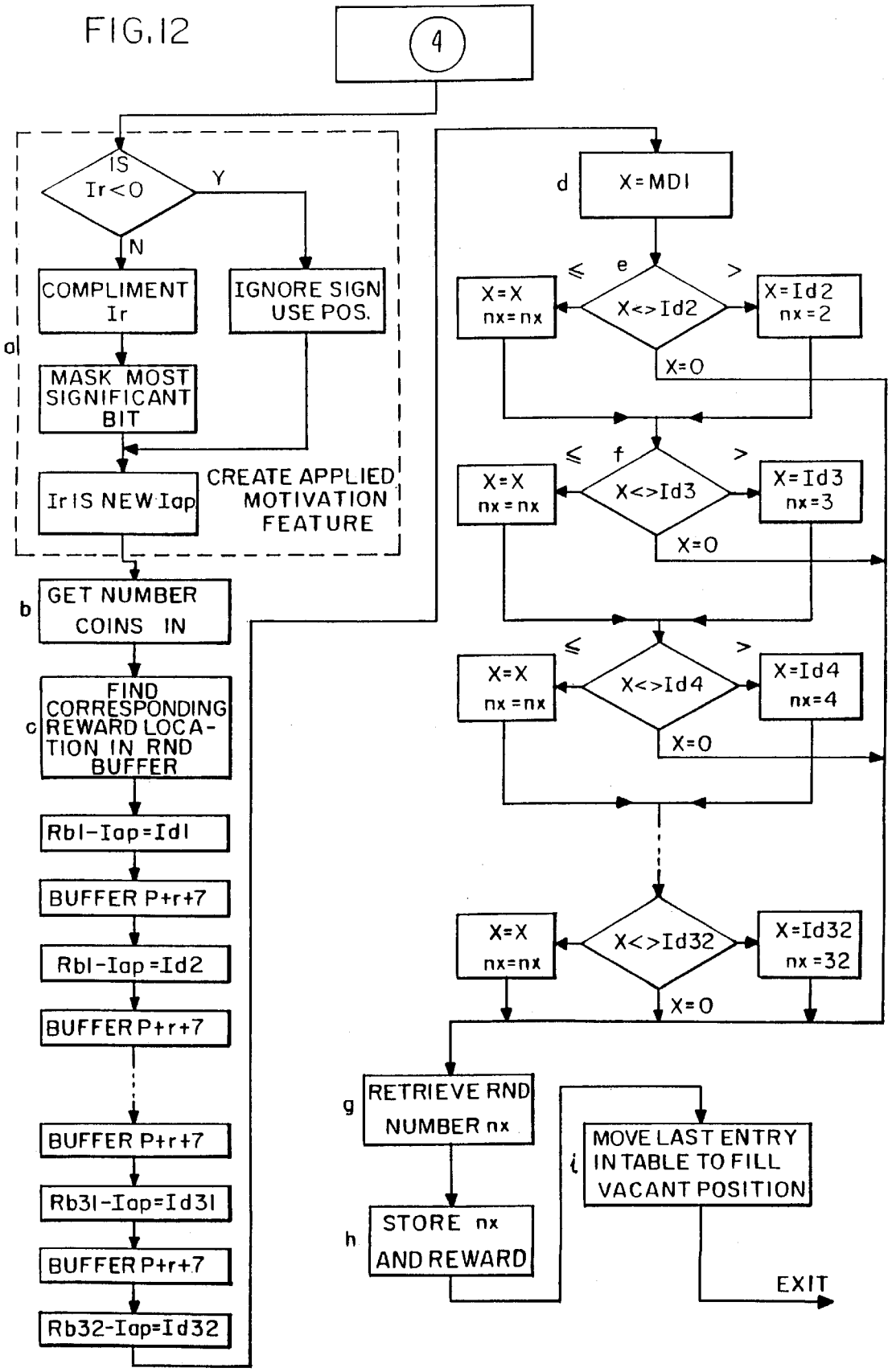

FIG. 12 is the flowchart which outlines the steps followed in the operation of the apparatus wherein the player's behavior characteristics are converted to a calculated incentive value. Then the random number and reward buffer is scanned for the closest match between the incentive value and available reward factors currently in the buffer.

Figure 13:
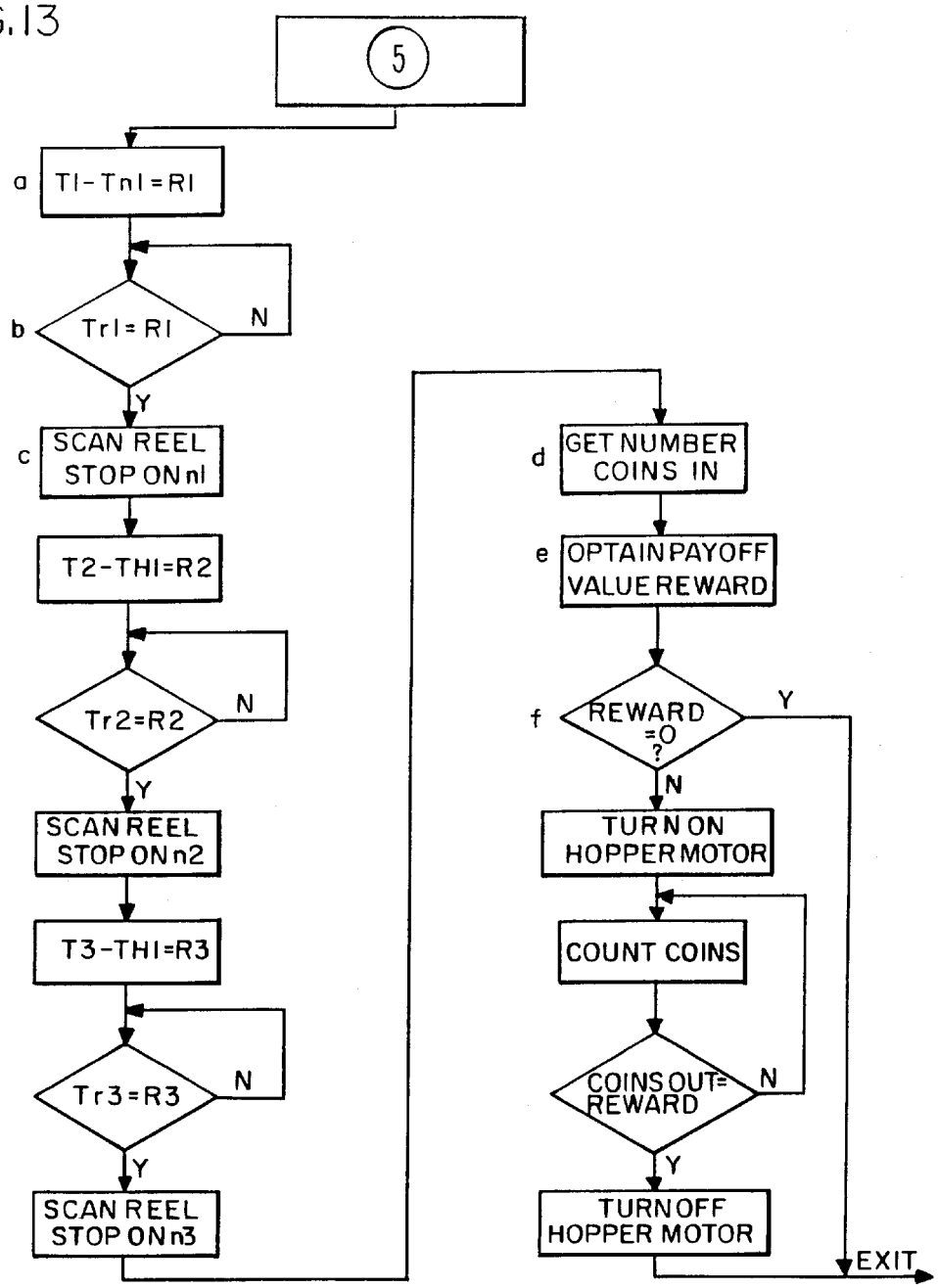

The flowchart of FIG. 13 shows the method which the apparatus uses to stop the reels and pay out a reward. A certain random number and reward value will have been picked by the routine of the flowchart of FIG. 12 and the reels stopped at positions corresponding to that value. The reward, if any, is paid out and the operation of the apparatus returns to the initialization block shown in FIG. 8.

Figure 14:
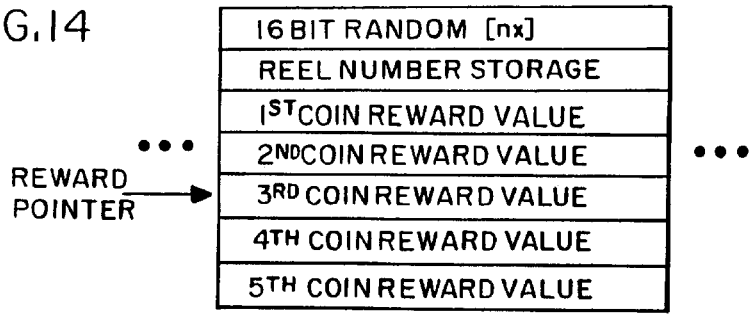

The block diagram in FIG. 14 shows a typical random number and reward buffer configuration for each random number. The total buffer size is 32 such sections in length.

The buffer shown in FIG. 15 represents the pattern of symbols on the reel as used on the apparatus 10. Each memory location contains a binary code that represents a symbol as shown. This table is needed for the determination of reward combinations. The buffer of FIG. 16 represents the win table. Each combination of the buffer contains three possible outcomes, followed by their corresponding rewards as shown. The codes for the respective symbols are the same as those given in the reel memory buffer shown in FIG. 15. The reward factor is given in binary notation.

Reels 19 of apparatus 10 represent the visual stimulus mentioned in the brief description of the invention. The reels are kicked into motion by the movement of handle 10*d* on kicking means 14. The handle can be pulled down only if the handle release solenoid 15 has been actuated under control of processor 40, thereby allowing the handle to move freely. The fact that the reels have started spinning is indicated by the kick switch 16 which is also used to indicate that the handle 10*d* has been pulled.

Reels 19 rotate in a normal fashion about the common axis of shaft 18 until the reels are independently forced to come to a stop by reel stopping means 11*a,* 11*b,* and 11*c* under processor control. As shown in FIG. 2 and referring to stopping means 11*a,* its solenoid 12 will release the corresponding ratchet 13 and allow the ratchet to fall into a notch on disk 17 when the solenoid is actuated. The ratchets 13 are reset by the action of the next handle pull by a mechanism (not shown) which is known in the art.

The photoelectric sensing means 50, shown in FIG. 6, allows the exact reel positions to be independently read by the processor for use in determining where to stop the rotating reels. The reel shown in FIG. 6 is stopped by the movement of the corresponding ratchet 13 into one of the notches of the adjacent disk 17. In the stopped position, the pattern of holes 51 in disk 17 will represent a specific binary code which represents the stopping position of the reel.

With respect to the light emitters 52 and light receptors 53 of sensing means 50 of FIG. 6, light is shown passing through the least significant bit position only, indicating that the reel has been stopped at position 1. This is for example only and it is understood that any other combination of holes may appear adjacent to sensing means 50. The information form sensing means 50 is buffered by drivers 54 and transmitted to processor input port lines. Respective sensors are enabled under processor control by bringing to logic 0, lines labeled -SENSE1, -SENSE2, and -SENSE3 as indicated by lines 55 of FIG. 6*a*. Also shown in FIG. 6*a* is resistor 56 which is provided to limit current to light sources 52, and resistors 57 which serve to bias photoreceptor transistors 53 which receive light from the respective light sources 52 through the holes in disk 17. A DC (direct current) voltage is supplied to circuitry 50 of FIG. 6*a* as well as to other circuitry elements of the present invention, this voltage being typically 5 volts DC. The concept of sensing reel position is commonly known in the art as shown in U.S. Pat. Nos. 4,071,246 and 4,138,114.

Control of the coin acceptor device of FIG. 4 is achieved with three sense and control lines from processor 40. A coin passing through the light path between light source 20 and light receptor 21 may be judged for size and shape and a determination made as to its validity. Resistors 24 and 25 (FIG. 4) associated with the sensor serve as current limiting and transistor bias resistors, respectively. Solenoid 22 is actuated if the processor 40 determines that the coin is valid. This allows a swingable door 22*a* to rotate to a position allowing the coin to pass into the hopper (not shown) and not to be rejected into tray 22*b*. If a coin passes the validity check, and accept solenoid 22 is actuated, the coin should pass by acceptance switch 23. If this does not happen, a coin jam condition is indicated and the machine will lock up into a 'tilt' condition. The voltage source to solenoid 22 is an AC voltage suitable for operating the solenoids and motors of a machine of this type. It is understood that solenoids of this type are common in slot machines and that this is only one of a number of ways of implementing the coin validity check. Reference patents relating to this subject matter include U.S. Pat. Nos. 2,539,855 and 3,998,309.

The coin storage and payout device 27 (FIG. 5) operates by rotating disk 31 using motor 34. In this way, the disk 31 acquires coins in cutouts 32 from storage in hopper bin 33. The disk 31 rotates counter-clockwise when viewing FIG. 5, transporting coins out of the hopper due to the action of flange 35 which ejects coins from cutouts 32 in the rotating disk 31. As each coin is ejected from the hopper, it rides under rocker arm 37, and arm 37 moves from the light path of coin sensor 36 and creates a signal (-DISK OUT) which indicates a paid out coin. Disk sensor 36 is comprised of photoemitter 36*a* with associated current limiting resistor 36*b* optically coupled to light receptor 36*c* and associated bias resistor 36*d*. Rocker arm 37 resides in the light path between emitter 36*a* and receptor 36*c* when no coins are passing arm 37.

Hopper motor interface circuit 38 (FIG. 5) acts as either a power source or a break depending upon the level of hopper logic line 39. When this line is brought high by the processor output port 47 (FIG. 3), the signal is applied to the input buffers 70 and 71. The output of buffer 70 assumes a logic low and conducts current through resistor 72 and the photoemitter of the silicon bilateral switch 73. The reason for this opto-isolation is to keep possible high voltage AC current from traveling back into the circuitry of the processor and doing significant damage. With this lower section of the silicon bilateral switch turned on, the gate of Triac 74 is biased through resistors 75 and 76 and switch 73. Triac 74 turns on, conducting AC current through hopper motor 34 causing rotation of disk 31. Capacitors 77 and 87 act as despiking capacitors and resistor-capacitor pairs 78 act as noise filters above the line frequency of 60 Hz.

When Triac 74 is turned on, Triac 84 is off since the high level of line 39 is transmitted through non-inverting buffer 71, turning the silicon bilateral switch off and causing Triac 84 to be unbiased. If line 34 is brought low, indicating that enough coins have been paid out and the hopper is to be stopped, then switch 73 is turned off, deactuating Triac 74. At the same instant, switch 83 becomes active by the action of current passing through resistor 82 and the photoemitter of switch 83. This biases Triac 84 which turns on and acts to short circuit the rotating hopper motor 34. This low impedance load causes motor 34 to stop almost instantly, thereby prohibiting additional coins from leaving the hopper.

Triacs 74 and 84 complementary and cannot be actuated at the same time. If this should happen due to component breakdown, the AC source would be shorted to ground, creating a dangerous condition. However, fuse 79 is used to relieve this situation if it should occur. Also, the driving circuits for the Triacs are the same except for the series configuration of the Triacs themselves. Thus, components 84, 85, 86, 87, and 88 in the upper or breaking circuit of FIG. 5 serve the same purpose as components 74, 75, 76, 77, and 78 in the lower or powering circuit.

In FIG. 3, processor 40 can be one of any number of different processors which are commercially available. Processor 40 is shown as having an 8-bit data bus with control lines such as -RD, indicating a read function, -WR indicating a write function, and -IO/M, distinguishing between a control and a memory operation. Clock crystal X1 is used to provide a frequency of operation to the processor. Most available processors operate between 1 and 5 megahertz as a maximum.

ROM 41 is the area of memory where program storage is provided. This ROM contains the instructions that govern the pattern of operations of apparatus 10 as described by the flowcharts shown in FIGS. 8–13.

RAM 42 is the memory that the processor uses as a temporary storage buffer or register for values in the system that are constantly changing, such as generated random numbers, operational by-products and lookup table pointers.

Time counter 43 is the component used to determine both absolute and relative time durations to use as a measure of the incentive characteristics of the player. It is not a memory device, but a specialized input/output register that is accessed as a control block. It also incorporates a crystal X2 that determines its operating speed independent of the processor.

Input ports 44 and 46 are used when various parameters in the system are to be sensed, such as reel location, handle pull or coin insertion. Output ports 45 and 47 are used when various parameters in the system are to be controlled, such as selection of a reel to be read, accepting or rejecting a coin, or stopping the reels from spinning. These input and output ports often must work in conjunction with each other. For instance, to read a specific reel 19, such as reel 2, assuming the three reels 19 are considered reel 1, reel 2, and reel 3, respectively, the -SENSE2 line (FIGS. 2 and 6*a*) must be brought low through output port 45 (FIG. 3), thereby selecting the reel 2 position sensing circuit. Then lines 80–84 (FIG. 2) must be read by input port 44 (FIG. 3) to determine the current position of reel 2. Block 48 (FIG. 3) is used to generate a chip select signal (-CS) for each I/O port in the system from processor address and control lines. Depending upon the unique condition of the processor control lines, the I/O selector block 48 will bring to a logic 0 one of its select lines directing a single I/O port to become active at that time. In this manner, the processor controls the complex functions of apparatus 10. Block 49 (FIG. 3) is a chip select generator that works in much the same way as block 48. The difference between the two is that block 49 generates a single select signal for the ROM block 41.

In the circuitry shown in FIG. 3, some of the low voltage logic signals must be converted to be compatible with the higher voltage and current requirement of the system solenoids and hopper motor as described above with respect to FIGS. 4 and 5. The solenoid interfacing is accomplished by the circuitry of FIG. 7 as described above wherein five identical circuits provide the necessary conversion. The circuits of FIG. 7 basically comprise an optocoupled silicon bilateral switch connected to a high current Triac. Referring to the circuit denoted by the numeral 60, a low voltage signal at logic 0 will turn on silicon bilateral switch 62 through current limiting resistor 61. The corresponding Triac 65 then becomes properly biased through bias resistor 63 and 64 and switch 62. Components 66 and 67 act as despiking and filter elements, respectively. When the Triac conducts, it draws AC current through the load such as a solenoid and completes the circuit to ground, thus turning the solenoid on. The optical link prevents unwanted voltage from winding its way into the processor circuitry.

FIG. 8 shows the overall flowchart describing the operation of apparatus 10 as it applies to slot machine operation. Note that control blocks numbered 1–5 are laid out in much greater detail in FIGS. 9–13. For the sake of clarity, the function of apparatus 10 will be described in operational order, ie., the path of operation the machine takes from a given point during normal operation of the system. Certain aspects of the hardware which have heretofore been explained will be referred to in describing system operation. Since the hardware and software domains are totally interactive in a controlled system such as this, one cannot be discussed completely without referring to the other.

Using the initialization routine as the starting point, the handle release solenoid 15 is set to 0 or off, thereby locking the handle against any pulls which may be attempted before coins are inserted. A memory location in RAM is designated as the coin counter and set to 0 indicating that no coins have yet been inserted in the machine. Also, in a buffer in RAM, a series of 31 random numbers will reside along with their associated reward values. This buffer will be described in more detail hereinafter.

After the initialization routine, the program proceeds to block 1 as shown in FIG. 8. This block is the random number generator and input sensing routine. Its basic function is to generate a random number and to check for coin entry or handle pull. If a coin is inserted, the routine checks coin validity and keeps track of the number of coins inserted. If the handle is pulled, control is passed to block 2 and the random number is stored along with its associated reward value. Also, a time value is stored for use in later determining player incentive as described in block . Whether or not a new player is at the machine is determined in this block, and an incentive value is calculated for the new player. This is central to the concept of the present invention in that it forms the basis for a determination in block 4 of the reward to be paid to the current player. Block 5 stops the reels on the selected combination of symbols and pays the reward due. FIGS. 9–13 are the subroutines represented by blocks 1–5, respectively, in FIG. 8.

Referring to FIG. 9, which is the subroutine associated with block 1 of the flowchart of FIG. 9, the first step in the loop routine of FIG. 9 is to check for a handle pull by reading the status of kick switch 16 (FIG. 2) through input port 44 (FIG. 3). Since, at this time, the handle release solenoid 15 is inactive, no handle pull will be possible and the routine takes the NO path to the next decision box. In this box, a check is made to see if a coin has been deposited in the coin acceptor. It does this by checking the -VALID DISK line through input port 46 (FIG. 3). If a coin has been inserted, the routine follows the YES path out of the random number loop hereinafter described. If no coin has been inserted at this time, the NO path is followed into the random number generator. This section reserves RAM buffer area for a three digit base 22 number. Each digit represents on of 22 possible symbol locations or stopping positions on each of the reels of the slot machine. The generator simply increments through the count until a coin has been inserted or a handle pulled, whereby it services those functions and then returns to incrementing through the numbers. Since this occurs at a high rate of speed, the randomness comes from the uncertainty in time between coin insertions or handle pulls.

Following through the path, the first task is to increment the count of the reel 1 digit (least significant digit). A check is made for rollover or count equal to 23. If YES, the counter is set to one and the path is followed to service reel 2 where the same check is made. If NO, the path through delay 1 is chosen and the system returns to checking for coins or handle pulls.

The NO path through delay 1 is exactly the same length as the YES path to service more significant digits. Thus, no matter which decision is made, it takes the same amount of time to return to the coin and handle pull input routines. This assures the perfect randomness of the generator by not allowing any particular combinations of numbers to remain in the buffer longer than any other combinations, even during rollover. The other delay boxes shown in FIG. 9 operate in the same manner. The NO path of the reel 2 decision box is exactly the same length as the YES path and the same holds for reel 3. This cycle continues endlessly until the first coin is inserted, whereupon the routine then exits out of the coin YES path. To trace operation from here, reference is made back to FIG. 8.

Assuming a coin has been inserted, and based on information from the -VALID DISK signal of the coin acceptor, a determination is made as to whether or not to accept the coin. If the coin is invalid, it automatically falls into tray **22*b* (FIG. 4) and the routine returns to the random number generator. If the coin is valid, a check is then made to be sure that five coins haven't already been inserted, assuming this machine was designed to accept five coins, as many are. Since this is the first coin inserted, the coin counter should read zero and the coin will be accepted. Had this been the sixth coin, it would be diverted to tray 22*b*** and the routine would return to the random number generator to await a handle pull.

To accept this coin, the processor activates the coin accept solenoid 22 (FIG. 4) through output port 47 (FIG. 3) and the interface circuitry shown in FIG. 7. This will divert the coin into the hopper. A check of the -DISK ACCEPTED line of switch 23 in FIG. 4 should verify this. If the switch is not actuated by a passing coin as read by input port 46, then a coin jam condition has been detected and the machine enters a tilt condition and locks up for service by a technician. If the coin does pass into the hopper, the coin counter is incremented and the handle release solenoid is actuated allowing the handle to be pulled. Control now returns to the random number generator to await another coin or handle pull. Additional coins are treated in the manner previously outlined; however, a handle pull input causes the random number generator routine to exit to block 2 of FIG. 8. Reference is made to FIG. 10 for details of block 2.

When the handle has been pulled, the reels are set in motion. The first task of block 2 is to store the generated random number at the end of the 32 section random number and reward buffer previously described. The reward buffer pointer is then set to the position for the first coin reward as shown in FIG. 14. Then values for minutes and seconds are retrieved from time counter 43 of FIG. 3. As indicated in block a of FIG. 10, these values are stored in a temporary buffer for later use in determining incentive. The routine will now compute five reward values, each corresponding to the insertion of an additional coin. This is accomplished by first setting three memory pointers in the reel lookup table corresponding to the three digits of the recently stored random number. FIG. 15 shows such a table wherein space is provided for storing codes corresponding to the symbols on the actual reels.

As shown in FIG. 15, for example, the reel pointers have been set to reel 1, position 9 (denoted 1–9); reel 2, position 20 (2–20); and reel 3, position 13 (3–13). This is the actual combination by which wins are computed. The pointers for the first, second, and third reels are referred to as REELMEM 1, REELMEM 2, and REELMEM 3, respectively. These pointers are set to the recently generated and stored random number which indicates the positions of the reels on the center line of symbols of the slot machine when stopped. This function is carried out in block b of FIG. 10. It is necessary to state here that the reward calculation flowchart of FIG. 10 was designed specifically for a 5 line pay type machine. It is understood that the same techniques can be used to calculate the reward factors for generally any machine it is applied to. In the 5 line pay device, a player may win on the center line of symbols if only one coin is played. However, if two coins are played, he may win on both the center line and the upper line of symbols. Since there are three rows of symbols visible on this type of machine, additional coins would result in possible wins on the lower line and the downward and upward sloping diagonals as well. These rewards are cumulative; thus, a player may win on more than one line if multiple coins are inserted.

Block c of FIG. 10 indicates that the center line values retrieved from the reel lookup table are compared to the win table. A section of the win table is shown in FIG. 16. Its format is as shown, with three possible symbol combinations listed followed by the respective reward associated with that combination of symbols. In some cases, cherries in combination with anything else leads to a reward. The "anything else" is represented by "don't care" codes. In FIG. 16, the first three combinations represent the possible outcome of any two cherries resulting in a reward of 5. The last combination shown indicates that three oranges pays 20. The three center line symbol codes represented by the random number are compared with this table for a possible match. If one is found, the associated reward value is retrieved and stored in the location indicated by the reward pointer following the associated random number. This is more clearly shown in FIG. 14. The reward pointer is then incremented to point to the second coin reward value storage location as indicated by block d, FIG. 10.

In block e, the REELMEM pointers are all decremented to point to the symbols appearing under the upper line and the win table scan is performed again, as in block f. The reward value, if any, is added to the reward value from the first coin calculation and stored in the second coin reward value location pointed to by the reward pointer. The reward pointer is then incremented by 2 in preparation for the next calculation as indicated by block g. This process continues on through five reward calculations in much the same manner by shuffling the REELMEM pointers to the proper payline locations for the number of coins being calculated and comparing the current combination to the win table. The reward is then summed with the previous reward value and stored in the proper reward buffer location indicated by the reward pointer which is incremented after each calculation. When the path of operations leaves this reward calculation routine, the buffer space following the current random number contains five reward values corresponding to each of a possible five coins for that random number. This is shown in FIG. 14.

System control is now turned over to the section that determines the relative incentive of the player. This is outlined in the flowchart of FIG. 11. According to the flowchart, this determination is based on three basic parameters: time between handle pulls or response time to the symbols appearing in the display, time of day, and calendar time. Also, it should be noted here, and is described in more detail later in the embodiment, that operation changes according to how well a player is doing playing the machine. This is referred to as score. It should also be understood that a much more complex and accurate measure of the player's incentive could be obtained by considering other parameters such as coin value of the machine, season of the year, weather patterns, and location of the machine in the casino. Even differences between one casino and another are thought to have a bearing on a player's behavioral characteristics. Where certain measurable characteristics are significant in some casinos, those same characteristics may prove to be less significant in other casinos in terms of determining player incentive. For this reason, machines could be specifically programmed for a given location. The dynamic changes in player characteristics which are sensed by the machine are the most important in determining player incentive. The routine described in FIG. 11 constitutes the feedback path necessary for the machine to sense player behavioral changes and put that information to work in determining optimal machine operation necessary to maintain player incentive to continue to play the machine.

Block a of FIG. 11 subtracts the time of the last handle pull (Th0) from the time of the present handle pull (Th1) to give the difference in time (Td) or the time between pulls. This time difference also takes into account the time required by the machine to complete is own operations subsequent to the last handle pull Th0 and eliminates it from the factor Td. Thus. Td is an accurate representation of the time elapsed from the point at which the player is able to operate the machine, to the point at which he does operate the machine. These values were retrieved from the time counter 43 of FIG. 3 and stored in buffer space subsequent to sensing a handle pull as described earlier. In block b, the time difference Td is compared to a value Tp which is a predefined maximum time between plays. This step determines if a new player has commenced activity at the machine. If the time elapsed since the last handle pull Td is greater than the accepted maximum time between pulls Tp, a new player is considered to be at the machine. The present handle pull Th1 becomes the past handle pull Th0, the current random number and its associated reward is placed in a special location to be output to the reels as shown by the "NEW PLAYER" path in block 5 of FIG. 8, and the value of absolute motivation (Ma0) is set to zero, indicating the value of absolute motivation is indeterminable at the time of the first handle pull. The machine operation up to this point has been unmodified and is performing in the same way as a regular slot machine. The machine is, however, building up a data base to use along with subsequent handle pulls to determine the player's relative incentive.

On the second handle pull by the same player, block b of FIG. 11 takes the NO path. This provides a valid elapsed time between pulls for the same player and an absolute motivation value can be assessed.

The time difference Td is adjusted by subtracting from it a value equal to the amount of time consumed by coins falling into the machine. This value is computed by multiplying the time it takes for a single coin to enter the machine Tc, by the number of coins inserted Nc, as in the flowchart of FIG. 11 after block b. This adjustment eliminates the effect which varying numbers of inserted coins have on the time value Td. The adjusted time difference Td is then sequentially compared to increasing intervals T1 through T7 to categorize the enthusiasm with which the handle is operated. It is possible that the number of coins inserted into the machine has something to do with player incentive. If this factor were to be taken into consideration by the machine in calculating incentive values, it would be done so during subsequent steps of the flowchart of FIG. 11.

A value Ma1 from 1 to 8 indicating the quantity of enthusiasm is obtained in steps c through i. In steps j through l, a multiplicative factor of 1 to 4 is applied to Ma1 depending on the hour of the day in which the machine is being played. Likewise, in steps m through o, a multiplicative factor of 1 to 4 is applied to Ma1 depending on calendar time or the day of the week at the time the game is being played. A current absolute motivation factor Ma1 has now been formed and has a range from 1 to 128. The important measure, however, is relative incentive Ir, or how much the absolute motivation changes from one pull to the next.

Step p determines if the calculation of relative incentive is possible. It checks the past absolute motivation for zero. If it is zero, that means that it is not possible to determine relative incentive since there are not at this time two values of absolute motivation (Ma0, Ma1) to compare. Since this is only the second handle pull for this player, the present absolute motivation Ma1 becomes the past absolute motivation Ma0, the present handle pull time Th1 becomes the past handle pull time Th0, and again the current random number and its associated reward are placed in a special location to be output to the reels in block 5 of FIG. 8. Up to the point of the third handle pull, the machine has acted as an ordinary slot machine while accumulating data about the player's behavior.

On the third handle pull, the machine has in storage a past absolute motivation factor Ma0 that was generated on the last cycle. On this cycle, the system begins by calculating the present motivation Ma1 from the past and present handle pull times and completes the calculation in steps c through p (FIG. 11), just as after the second pull. At decision block p, however, Ma0 is non-zero since it now contains the past absolute motivation value. The NO path is taken and Ma0 is subtracted from Ma1 to determine the relative incentive Ir. Then Ma0 is set equal to Ma1, and Th0 is set equal to Th1 in order to prepare for the next play. The routine then exits to block 4 of the main program represented in more detail by FIG. 12.

Because the relative incentive factor Ir represents an increase or decrease in incentive since the last play, it can be a negative or a positive number in the range −128 to +128. A negative value represents a decrease in player incentive from one play to the next. A positive value represents an increase in incentive which is an indication that the player requires less of a reward to maintain his incentive to continue to play the game. The function of the blocks enclosed within the dotted lines at a in FIG. 12 is to make a determination of the relative incentive Ir and convert it to an applied incentive factor Iap which represents the ideal reward for the current play. This Iap is the optimum reward, as determined by the machine, that the player should be given as an incentive to continue to operate the game. The function blocks within a of FIG. 12 indicate the binary math required to convert the relative incentive Ir into the applied incentive Iap. The routine first checks to see if Ir has decreased (is negative). If so the YES path is taken, if not, the NO path is taken. The algebraic equivalent of the YES path is given by /Ir/+128, meaning the sum of 128 and the absolute value of Ir. The algebraic equivalent of the NO path is given by /Ir−128/, meaning the absolute value of the difference between Ir and 128. The result is an Iap between 1 and 256, representing an Ir between −128 and +128 respectively. It is clear that Iap is low for a measured increase in incentive and high for a measured decrease in incentive. This calculated value for Iap must now be matched as closely as possible with the random number and reward buffer for the number of coins inserted during this play of the machine.

To do this, the difference between Iap and each of the 32 reward values must be obtained. Then, the difference values are compared to find the smallest one. This is all accomplished by the control blocks in the remainder of FIG. 12. First, the number of coins Nc inserted this play is retrieved from the coin counter in block b (FIG. 12). The corresponding reward location for that coin count in the first random number section of the 32 number buffer is found and the buffer pointer is set to that location as in block c. The value in that location is designated Rb1 for reward buffer section 1. Subsequent reward values are spaced 7 locations apart in the memory domain and are referred to as Rb2–Rb32. The applied incentive Iap is subtracted from each value and the buffer pointer is incremented seven times to retrieve the reward value from the next section. The result of these subtractions forms 32 incentive differentials which are designated Id1–Id32. The task now is to find the smallest differential and use its associated random number to set the reels of the machine. This is begun in block d of FIG. 12.

A variable X is set to the value of the first incentive differential Id1. Its value is compared to that of the second incentive differential Id2 at decision block e. If Id1 is less than or equal to Id2 then it is passed on to block f for comparison with Id3. If Id1 is greater than Id2, then Id2 becomes the variable X and proceeds to be compared with Id3 in block f. If X is of zero value, then a perfect match has been found and no more comparisons are necessary. The routine proceeds this way until all 32 incentive differential values have been compared or a zero value has been found. The final value of Nx is the location in the buffer space of the random number that was chosen by the previous comparison routine. Block g uses the value of Nx to retrieve the chosen random number and its associated reward value. Block h stores that random number and the reward in the special location used by block 5 of FIG. 8 (detail shown in FIG. 13) to determine the stopping positions of the reels, and reward payout. Then block 1 of FIG. 12 moves the last random number entry in the buffer area along with its reward values to fill the position vacated by the chosen number. The random number buffer area now contains 31 entries and will be adding a new entry at the next handle pull.

The final flowchart in the series is the reel stopping and reward payout routine shown by block 5 of FIG. 8. Reference is made to FIG. 13 for a detail of this procedure. First a determination of how long reel 1 has been spinning is made. This can be done by counting the duration of spin or the number of rotations of the reel. For a duration calculation, the time of the current handle pull Th1 is subtracted from the current time T1 to arrive at the reel spin time R1 in block a. Block b checks this value against a predetermined reel 1 spin time Ir1. When the values become equal, block c scans the reel position sensor for reel 1 by the activation of the -SENSE1 output line and by reading the data from lines BIT0–BIT4. When the reel position sensor indicates the reel is at the position required by the random number which was stored in the special buffer location, the corresponding reel stopping solenoid is activated by the processor through output port 47 (FIG. 3) and the interface circuitry of FIG. 7.

Procedure for the other two reels follows the same course, each with their own independent stopping time values Tr2 and Tr3, with position sensing accomplished by activating -SENSE2 and -SENSE3 output lines, and reel stopping accomplished by activating the corresponding solenoids 12 (FIG. 2). The remainder of the flowchart processes the reward information. Block d of FIG. 13 references the coin counter. This value is used in block e to pick the proper reward from the special location in which the chosen random number and its associated reward values have been stored. Decision box f checks the reward for zero and exits if true. If nonzero, however, the coin hopper motor is activated as indicated and the processor begins counting paid out coins through input port 46 (FIG. 3) until the reward criteria is met. The most practical way of doing this is to decrement the reward value each time a coin leaves the hopper. When the reward value has reached zero, the hopper motor is deactivated as indicated. The routine then exits to return to the initialization routine to prepare for another play.

By using this random number selection buffer method, the machine has the opportunity to choose the number and reward that is most suited to the incentive requirements of the player at any given time and still maintain the integrity of the machine a randomness and inherent return percentage. As was shown, the player's incentive is determined from the time between handle pulls as well as the time at which the game is being operated. Since the determination is made from the detected change in incentive from one play to the next, a player who has been losing incentive and receiving several high rewards will eventually end up with a low value of absolute motivation Ma1 such that any further plays will represent an increase in incentive and the machine will discontinue paying high rewards. Also, if several high rewards are paid out from the buffer faster than new ones are replaced, the chance of receiving further high rewards becomes substantially diminished due to the limited capacity of the 32 number buffer. In these ways, the machine is changing its operation in response not only to player characteristics, but also according to score and the history of past plays. This self-regulating nature assures that a player may not beat the machine at its own game.

While it is understood that there are other methods of feedback assessment and implementation in gaming devices of this type, the foregoing description has been chosen, for the sake of clarity and simplicity of example, to show only one method for practically implementing the concepts brought forth in this invention. The additional embodiments outlined in this disclosure illustrate alternative means by which the concept of the invention may be applied to gaming devices other than slot machines and that the invention is by no means limited in scope of application to slot machines.

Figure 19:
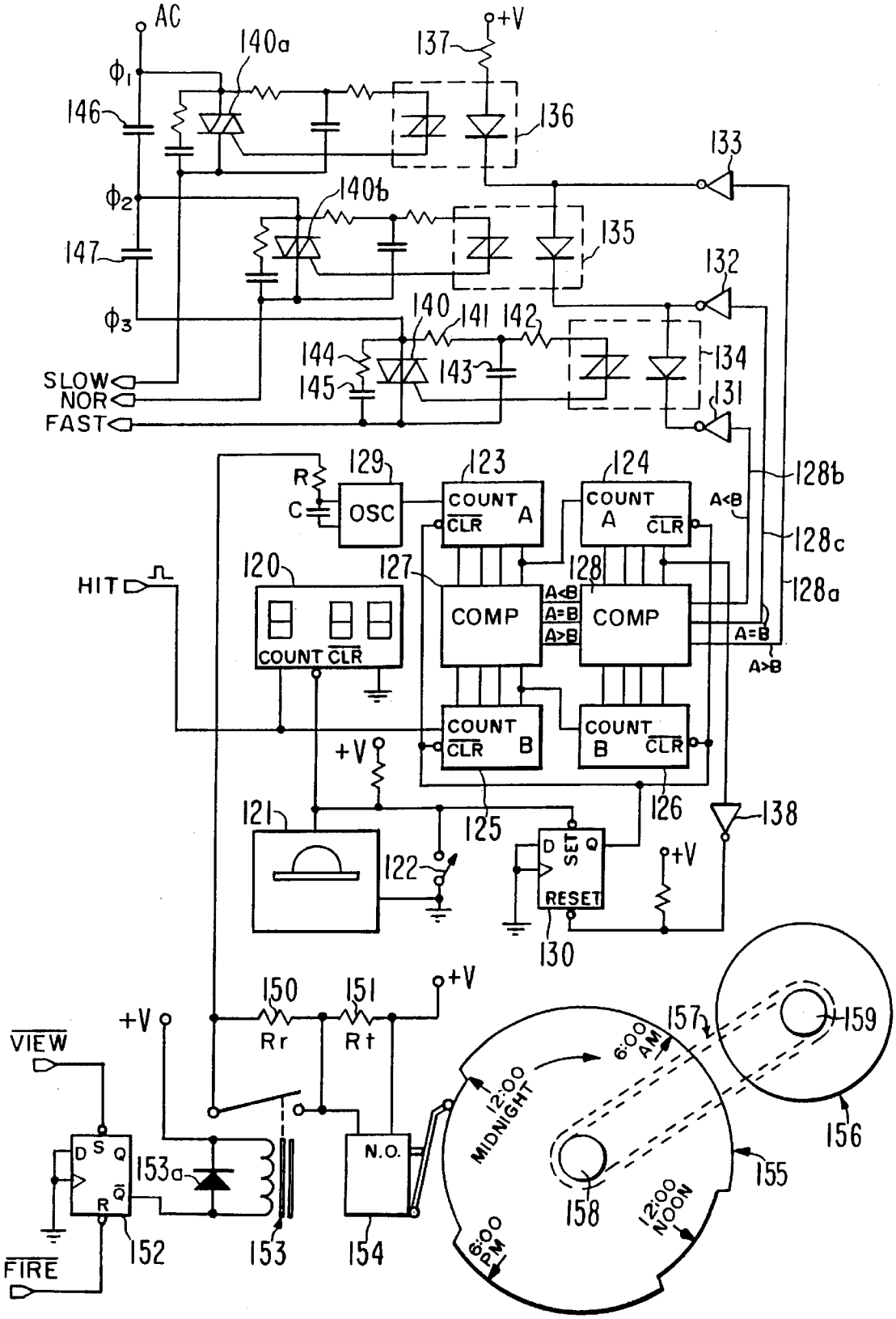

The present invention as applied to an arcade game is shown in FIGS. 17–19. The arcade apparatus 100, for purposes of illustration, includes a support structure in the form of a rotatable wheel 103 mounted for rotation on a shaft 104. The shaft is driven by a gear or pulley 105 coupled with a chain or belt 106. The chain or belt is coupled to a gear or pulley 101 driven by a three-phase electric motor 114 having a drive shaft 115 on which the gear or pulley 108 is mounted. Although other types of motors are suitable for this use, a three-phase AC motor has been described due to its reliability and ease of changing rotational speed by switching phases as will be described. It is understood that the natural rotational speed of the motor will have been geared down to allow wheel 103 to turn at a reasonably normal speed for target practice.

Wheel 103 has an outer periphery or zone provided with symbols or targets 107 thereon. These targets are to be shot at by a game player holding a gun 110 (FIG. 1B) containing a switch and pull-up resistor 110*a*. When fired, the gun emits a projectile 109 and simultaneously closes a switch causing a logic low signal to appear on the -FIRE line. This signal is used by the time response circuitry as will be described. The targets are mounted on hinge elements 108 (FIG. 18) in such a manner as to allow the targets to fall rearwardly, i.e., out of the plane of rotation of wheel 103, when struck by a bullet 109 from gun 110. On the back side of each target 107 is mounted a flat paddle 111 which is used to break a light beam from a photoemitter 112 comprised of light emitting diode 112*a* and a current limiting resistor 112*b*. The breaking of the light beam occurs when the target 107 falls after being hit by a bullet. This is detected by a photoreceptor 113 comprised of phototransistor 113*a* and bias resistor 113*b*. A hit appears as a logic high pulse on the HIT line of photoreceptor 113 which goes to the control circuitry of FIG. 19 for accounting and processing. A target that has been knocked over is automatically reset by gravity when the target reaches the lowest point of rotation on the support structure or wheel 103 and is beginning to move upwardly toward the top point of rotation of the wheel.

Also mounted on wheel 113 is a fixed cam wheel 114. Each depression on the cam corresponds to one of the figures 107 mounted on rotatable wheel 103. Riding along the periphery of cam 114 is a spring loaded microswitch 115 and associated pullup resistor 115*a* which are mounted apart from the rotatable wheel. Microswitch 115 is closed when its activating lever 117 falls into a depression 116 on the cam 114. The cam is mounted on wheel 103 in such a way that just as the next figure 107*a* comes into view of the player, the lever of the microswitch 115 falls into the depression and sends a logic low pulse out on the -VIEW line. The -VIEW signal is used by the circuitry of FIG. 19 to compute player response time to the symbols as they appear. This will be described in more detail in the next section. In FIG. 17, the microswitch is shown in this position as a new figure comes into the player's view.

Referring to FIG. 19, an electromechanical counter 120 is provided to indicate to the player the number of hits on targets made by the player. Counter 120 is a low voltage, solenoid-actuated counter of the type generally known in the art, although any type of counter could be used here with the proper interfacing. As shown, a logic high pulse on the HIT line will increment the counter. A logic low pulse on the clear line will reset the counter to zero.

A simple coin switch 121 has a manual switch 122 associated with it. The coin switch is of the type generally known in the art and it performs a simple mechanical check for coin validity and it actuates a microswitch as the coin falls into a coin box. In the alternative, a player may actuate switch 122 to start the game.

FIG. 19 further includes the electrical components that make up the processor section of apparatus 100. These components include ideal hit counters 123 and 124, actual hit counters 125 and 126, and performance comparators 127 and 128. An oscillator 129 emits counts which will be used as the ideal hit rate, and a latch 130 is used to indicate that a game is in progress. The counters and comparators are cascaded to handle the number of possible hits per game. The decision output lines of the most significant comparator 128 are buffered by open collector inverters 131, 132, and 133. These lines drive the optoisolated silicon bilateral switches 134, 135, and 136, respectively. This is the motor interface section of the processor. Switches 134, 135, and 136 are used to isolate the high voltage AC current used in the motor from the low voltage DC current used in the logic of the counters and comparators. Each of the switches 134, 135, and 136 drives an associated Triac circuit. The task of each Triac circuit is to turn on successive phases of the three phase motor, thereby varying the speed of the motor. Since each Triac circuit is identical, only one will be discussed.

When switch 134 is actuated by the processor, it biases the gate of Triac 140 through bias resistors 141 and 142. Capacitor 143 acts as a despiking element in conjunction with resistors 141 and 142. Resistor 144 and capacitor 145 act as a high frequency filter to keep switching noise from the power line. When Triac 140 has been turned on, it conducts AC current through capacitors 146 and 147 and out through the line labeled FAST to motor 114. The purpose of each of the capacitors 146 and 147 is to shift the phase of the AC supply by about 60 degrees each to conform to the requirements of the motor. If a transformer type induction AC motor is used instead of a three-phase motor, the phase shift capacitors could be eliminated and the AC power switched directly through the Triacs to the taps of the motor transformer. In any case, whenever a Triac is turned on, the current is conducted to the Triac and applied to the associated line on the motor.

When apparatus 100 is not in use, latch 130 is in a reset condition, meaning that the Q output of the latch is a logic Q. The Q output is connected to the clear lines of counters 123, 124, 125, and 126. Since the value in counters 123 and 124 (the A counters) and the value in counters 25 and 26 (the B counters) are 0, comparators 127 and 128 sense an A=B condition and bring that line 128*c* to a logic 1 or high. This turns on inverter 132 whose output goes low, thereby conducting current through limiting resistors 137 and switches 135 and 136 turn on their respective Triacs. This action applies two phases of AC to the motor 114 and causes the motor to rotate at a rate defined as NORMAL. Hence, when the game is inactive, all counters are set to 0 and the target wheel 103 revolves at a normal speed acting as an attention getter.

Apparatus 100 is actuated by inserting a coin in device 121 or by manually closing switch 122 (FIG. 19). Either of these actions will bring the set line of latch 30 to low which causes the latch to turn on. Either of these actions will further cause the reward counter to be cleared to zero. Then, the Q output of latch 130 goes high, freeing all devices from their cleared state. The A counters, counters 123 and 124, then begin counting ideal hits based on the frequency of oscillator 129. Oscillator 129 provides a count to the A counters at a rate that an average player is expected to be able to hit the targets on rotating wheel 103 turning at normal speed. Changing the frequency of operation of this oscillator changes the average difficulty of the arcade game because it defines the speed at which an "average" player is expected to hit the targets. The frequency of this oscillator will be defined as the IDEAL OPERATING LEVEL of the system and can be changed to match the skill of each player. This is done by changing the resistance value in the RC network as will be discussed. A change in oscillator frequency causes a change in the rate that counts accumulate in the A counters which are used as a basis for how well a particular player should be doing in playing the game.

While the A counters are counting ideal hits, counters 125 and 126 (B counters) are counting actual hits. Every time a target 107 is hit by a bullet shot from the gun by the player, the reward counter 120 increments, and the B counters also increment. If a player is doing poorly relative to the ideal count, the value in the B counters will be less than the value in the A counters, or A will be greater than B. The output line 128*a* of comparator 128 becomes active and, through driver 133 and switch 136, turns on the phase-1 Triac 140*a* only. This supplies one phase to the motor causing it to slow down slightly to a rate defined as SLOW. With the targets 107 now moving slower, the player has greater opportunity to hit the targets. The player becomes encouraged that his skill has improved and, as a result, has a greater incentive to continue to play the game. Conversely, if the player is doing well relative to the ideal hit counter, he may become bored and discontinue play. This condition is compensated for when the value of the actual hit B counters 125 and 126 is greater than the value of the ideal hit A counters 123 and 124. This is a result of the player doing better than average and the comparators generate an A less than B condition. This condition is applied to line 128*b* to driver 131 to turn on all switches 134, 135, and 136 and hence all of the associated Triacs to apply full three-phase power to motor 114, causing it to begin rotating at a FAST speed. The game then becomes more of a challenge to the experienced player.

Any condition in which the player is shooting and hitting the targets at a rate equal to that of the ideal hit counters is a condition represented by the state A=B of line 128*b*. In this state, the phase-1 and phase-2 Triacs 140*a* and 140*b* are actuated, causing wheel 103 to rotate at a rate defined as NORMAL. Due to motor characteristics, the changes of speed from SLOW to NORMAL to FAST are subtle.

Also included in this embodiment in addition to score are means to use information about player response time and time of day in modifying the difficulty or operating level of the system. This is done, as discussed previously, by changing the count rate of the expected hits counters 123 and 124.

Player response time is detected by latch 152. It does this by monitoring the amount of time between when a player sees the target 107*a*, and when he fired at it. When a target comes into view, a low pulse on the -VIEW line sets latch 152 which closes relay 153 and shorts resistor 150 effectively disconnecting it from the circuit. Diode 153*a* serves to protect latch 152 from harmful relay currents. When the player pulls the trigger of the gun, a logic low pulse on the -FIRE line resets latch 152, reopening relay 153 and reconnecting resistor 150 to the circuit. The time period that the relay is closed represents the response time of the player. If the player is very good at responding to targets, his response time is small and relay 153 is closed for only a short moment. Conversely, if a play hesitates before firing the gun, the relay is closed for a comparatively longer period. As stated, the effect of closing relay 152 is to disconnect resistor 150 or subtract it from the total resistance of the RC circuit of oscillator 129. This has the effect of increasing the frequency of oscillation and causing the expected hits counters 123 and 124 to accumulate counts faster. In this condition, an A>B state is more likely and will have the effect of slowing down the game as described. Thus, a player with slower response time will cause relay 153 to be closed for a larger percentage of total game time thereby decreasing the difficulty of the game by increasing the likelihood that an A>B condition will exist. A player with a faster response time will cause relay 153 to be closed for a smaller percentage total game time thereby increasing the likelihood that an A<B condition will occur, effectively making the game more difficult.

Time of day is detected by microswitch 154 (FIG. 19) whose lever rides on rotatable cam 155 which is turned by clock motor 156 using chain 157. Both clock motor 156 and cam 155 have gears 158 and 159 affixed to them which accept chain 157 for transmitting motion from the motor to the cam. In the alternative, the cam may be mounted directly to the clock motor. The motor 156 is a commonly available clock motor geared such that it turns cam 155 one revolution every 24 hours. Cam 155 is designed such that it has cutout depressions during times of the day when more practiced players are likely to be playing the game. As an example FIG. 19 shows cutouts corresponding to school lunch break and after dinner crowds of more experienced young players. At all other times it is assumed that less practiced players will be playing the game.

When microswitch 154 is riding on the outside rim of cam 155, it is closed, subtracting resistor 151 from the circuit and decreasing the difficulty of the game in the same way as previously described. When the switch is riding in the cutout depression as shown in FIG. 19, the switch opens and reconnects resistor 151 increasing the difficulty of the game.

In this embodiment, both response time and time of day are measured and applied to the circuit for use in changing the difficulty or operating level of the game. Response time is a continuously variable change since it is represented by the percentage of game time in which relay 153 is activated. In this design, time of day is a stepwise change represented by either a quantum increase or decrease in the average difficulty of the game depending on the particular time of day in which the game is being played. Values of resistors 150 and 151 should be chosen depending on the effect that each variable is to have in determining the operating level of the game. This is the most basic approach to applying these variables to this embodiment and it should be understood that more complex and elaborate designs could be created by someone skilled in the art.

While the motor speed is the parameter that is changed to alter the difficulty of the game in this embodiment, other parameters can be modified in conjunction with motor speed to widen the scope of challenge of the arcade game, or make the changes more subtle. Such other parameters include the amount of light which illuminates the targets, or the air pressure of the gun which shoots the pellets. In the case of the light illuminating the targets, the light can be brightened, kept the same, or dimmed to make it easier or harder to see the targets. In the case of air pressure of the gun, the air pressure can be increased, kept the same, or decreased to make it easier or harder to hit a moving target with a pellet from the gun.

The game is over when the ideal hit counters reach a predetermined value. When this happens, a signal line which is buffered by inverter 138 brings the reset line of latch 130 low, turning off the latch and resetting counters 123–126 to zero. Further hits do not affect the circuitry in this state. The reward device 120 retains the value of the past game performance and is used as a basis for awarding a prize. The reward is then automatically reset upon beginning the next game.

Although apparatus 100 is described as a target action game, it could be any game whose difficulty is determined by changing the timing, rate of change or speed of operation of a linearly or circularly moving member which bears symbols. If a gaming device contains the elements of a displaying device with a mechanically moving symbol on a support structure such as figures on a rotating wheel, a player operating device having an actuatable control member such as a target hit sensor, an accounting device such as a score and reward counter and/or payment device, and a processor that responds to player input and other measurable parameters such as time of day, then the present invention may be readily applied to same gaming device.

The teachings of the present invention can be applied to a video action game apparatus shown in FIGS. 20–24 and denoted generally by the numeral 200. Apparatus 200 is of the type commonly seen in electronic arcades and game rooms. The apparatus includes a computer 202 which, for purposes of illustration, can be an Apple II Plus personal computer. The computer includes an operating device having an actuatable control member such as an interactive keyboard 204 and an internal processor (not shown) within the housing 206 of computer 202. The computer has color graphics capabilities and also includes a real time clock as part of the internal circuitry. Programs are entered into the processor in BASIC computer language using keyboard 204. When a game program is run, the game is viewed in a zone on a television display or color monitor 208 and controlled by an input device 210 such as a knob or dial. Any computer system which allows for player interaction and contains graphics or cursor control and a real time clock can be used to demonstrate the teaching of apparatus 200. The intent of the invention is to use the input device to determine the operating ability of a player. This information is used to modify the operation of the game to achieve the effect of increasing player incentive to continue using the apparatus by making the game more interesting or challenging.

The basis of the prototype of this invention resembles that of a target action game in which the player controls a moveable cannon 212 (FIG. 20) at the bottom of the screen 214 of display 208. Cannon 212 is used to shoot a target 216 out of the "sky", i.e., the rest of the screen 214. At the beginning of play, target 216 starts at the top of the screen 214 and begins to move left, then to the right, and then downwardly in a seemingly random manner. The object of the game is to strike target 216 with one of the cannon projectiles before the target hits the "ground", i.e., the bottom of the screen. If successful, a new target 216 appears at the top of screen 214. If unsuccessful, the target has presumably destroyed the cannon at ground level and the game is over. The game can be played this way until the target moves all the way to the ground without being struck by a cannon projectile.

Ordinarily, a game of this type would be too difficult for some players; whereas, more competent players would find it easy and soon lose interest in continuing to play the game. The unique nature of the invention overcomes these problems by adding a feedback loop to the normal operation of the video action game. In this example, the accuracy of the player is represented by a parameter H which is derived from the fraction of shots hit to shots actually fired. This parameter is then used as a basis for modifying game operation to maintain the incentive of the player in several ways. The most fundamental change is in the variable T which is the time delay in the operating speed of the game. Smaller values of delay T cause the game to operate faster than large values of T.

The variable X4 is a target movement modifier. It determines how long the target lingers on the one line before moving down to the next line. This modifier is based on the value of H. Another change in game difficulty which is made based on the value of H is available ammunition variable C. In this particular game, ammunition is accumulated during each time period T of game operation. The modifier C determines how much ammunition is accumulated during each time period, and how much ammunition is used up during each firing of a projectile from the cannon. For a player who is doing well, ammunition is accumulated more slowly and used up more quickly. Two other modifiers are the target movement modifiers D and M1. D is the parameter that determines the weighting of the random left-right movement of the target. If ammunition is low, D allows the target to move to the left, to the right, or stay where it is. Otherwise, the target moves only to the left or to the right of its previous position at the next time period. However, if the player has a lot of ammunition and a high value of H, the target will move only left or right and, when it does, it will jump two cursor locations.

M1 is the movement modifier that allows the target to track toward or away from the line of fire of the cannon. For low values of H, the target will be weighted to have a tendency to track towards the line of fire if the target is within two columns of the fire line. Conversely, for high values of H and a target within two columns of the fire line, the weighting will make the target tend away from the line of fire. K3 is the time of day modifier. In this embodiment, when the game is being played between 4 PM and 6 PM or between 10 AM and 2 PM the game difficulty, represented by the parameter H, is increased by 50%. This accounts for the expected increased skill of players operating the game during those hours. Depending on the location and local social life, these hours can be changed to different times and durations or be made to have varying effects on the operating level as desired. Each of these system changes individually have a small effect on the difficulty of the game. However, their combined effect can make substantial changes in the operating level of the game. These system changes will be discussed more specifically along with their associated sections of the flowcharts of FIGS. 21–24 and the corresponding program listing identified as Table 1.

Figure 21:
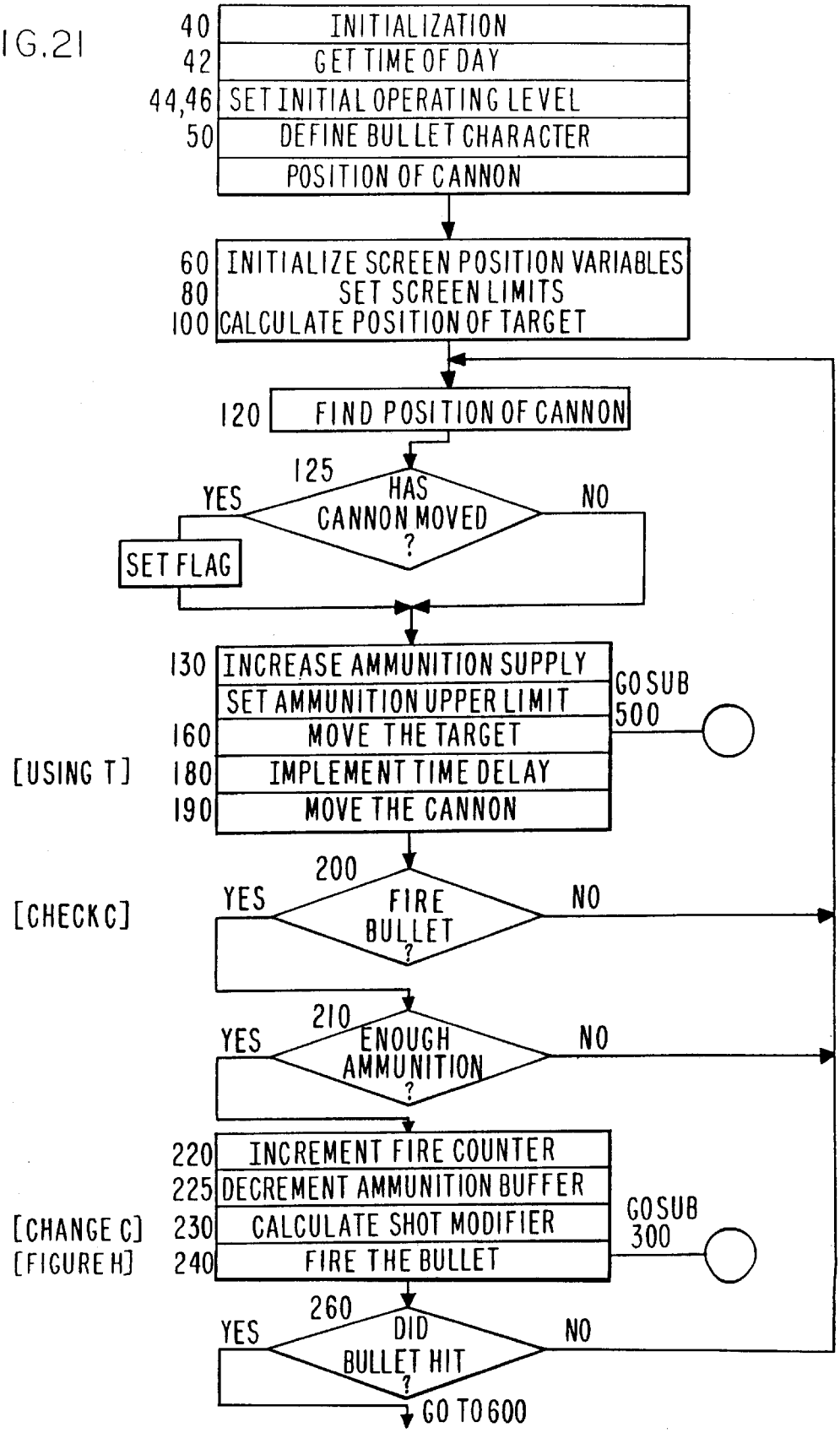

In reference to FIG. 21, the first two blocks of the flowchart provide initialization for apparatus 200. The initial operating level of the game is set depending on the present time of day and the fire counter F is preset to 9 shots so that a hit on the first try does not create a 1 to 1 hit-to-fire ratio. The screen domain or zone limits are defined and the target location is computed. The next few blocks determine the position of the cannon by scanning the player input device.

In line 160 of the program as indicated in Table 1 of the source listing, the target is moved under control of subroutine 500 (FIG. 22 and Table 1) and out back on the screen by line 170. Line 180 computes and implements the time delay or operating speed of the game based on the value of H. For higher values of H, which means that a player is doing well. T becomes a much shorter delay between target movements causing the game speed to increase.

After the time delay, the target position is moved on the basis of the decision in line 125. At this point, a check is made in line 200 to determine if the player pushed the firing button of the player actuator. If not, control returns to the section that begins with line 120 which computes whether or not the cannon has been moved and changes the location of the target. If the fire button has been pressed, a check of ammunition modifier C is made to see if enough ammunition has accumulated to fire a bullet. If not, control returns to line 120. If so, then the fire counter F is incremented, the ammunition buffer C is decremented, and parameter H is changed on the basis of the fired shot where R1 is the old or initial value of H.

Subroutine 300 is called upon to simulate a fired projectile and then in line 260 a check is made to see if the projectile has hit the target. If not, control returns to line 120. If so, the routine goes to line 600 (FIG. 24) to recalculate H based on the new hit. After H has been recalculated in subroutine 600, control returns to line 60 which initializes the game with a new target at the top of the screen. Everything is reset except the hit score which is computed in line 615 and the parameters H and R1 which contain information about player accuracy from previous plays.

Figure 22:
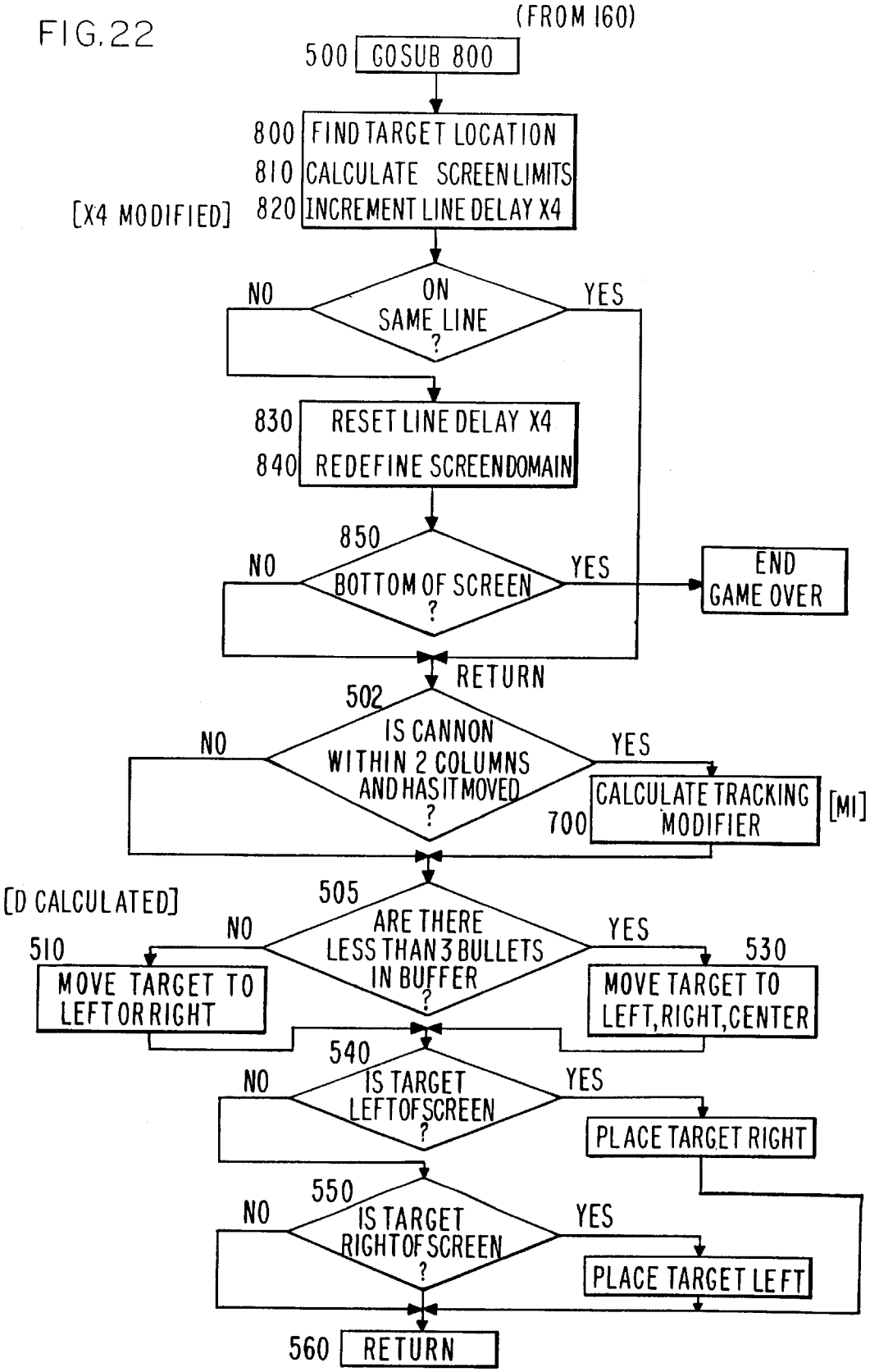

Reference is made to FIG. 22 for the flowchart of the target movement subroutine. It contains calculations for X4, D and M1, the target movement modifiers. Routine 500 immediately calls line 800 which is the X4 calculation routine. It determines the line location of the target and how long it has been on that line. The target may stay on the same line longer for low values of H: however, if H is high, the target must move down to the next line after fewer time periods. This calculation is handled in line 820. A check in line 850 is made to determine if the target is on the bottom line or "ground". If so, the game is over. If not, the routine returns to line 502. This line is the beginning of the M1 calculation routine. It determines if the cannon has been moved since the last time period and if the target is within two vertical columns of the cannon. If either one is within two vertical columns of the cannon. If either one is false, then M1 stays the same and the routine continues on to calculate the movement modifier D. If both are true, then the tracking modifier M1 is calculated in line 700.

The equation in line 700 consists of three basic parts. The first part uses H to determine whether the target should move toward or away from the cannon line of fire. The second part determines whether the target is to the left or to the right of the fire line. The third part determines whether or not H is extreme enough to warrant using the M1 modifier. The equation returns a value for M1 of 1, −1, or 0 depending on whether the target is to move toward, away, or have no tendency in either direction. The D calculation routine begins at line 505 by determining if there are fewer than three bullets left in the ammunition buffer. If yes, line 530 allows the target to move left, right or to stay in the same place if M1 is inactive. If three bullets or more are in the buffer, then the target may not remain in the same place, it must move left or right and it will jump two spaces if H is high. This makes it harder for a player to hit the target. The remainder of routine 500 makes certain that the target stays within the screen domain and corrects it if it is not. It then returns to the main calling routine at 160. These modifications all serve to make the game more challenging to players of all skill levels. Since there are so many subtle changes in the operation of the game, it is difficult for the player to notice that any changes at all are occurring. He will thus be satisfied that the game is sufficiently challenging for a person of his skill level no matter what that level might be.

Figure 23:
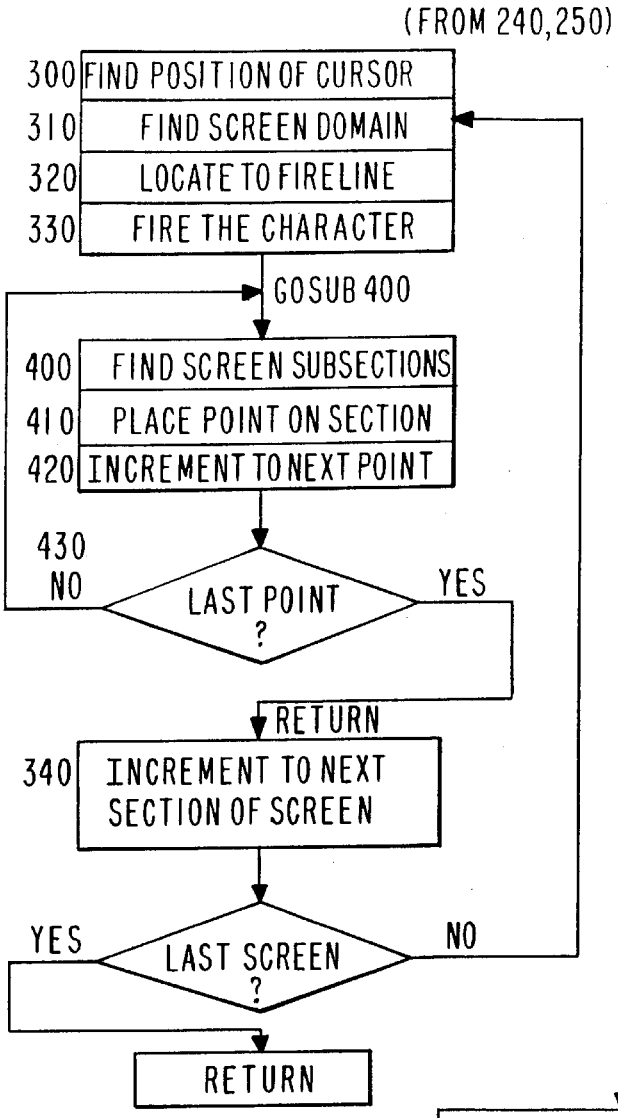

FIG. 23 contains a utility subroutine 300 which is the bullet firing simulation routine. Since it does not contain any modifiers exemplary of the invention, it will not be described in any detail. Its basic task is to determine where the projectile goes, divide the screen up into sections, and draw a series of characters on the screen.

Figure 24:
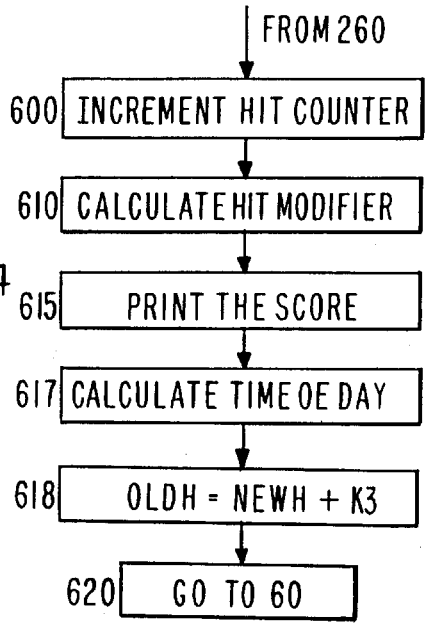

FIG. 24 shows the bullet hit routine at line 600. It has already been determined that a hit was made in line 260 before entering this routine. Thus, upon entry, the hit counter is incremented. The new H modifier is calculated in line 610 by the fraction of shots which hit the target over the total number of shots fired. It is then multiplied by a constant which converts the fraction to a factor which can be incrementally modified by the program depending on player ability. The new H value then replaces the old H value multiplied by the time of day modifier K3, and the sequence starts over with initialization as described beginning with line 60.

Apparatus 200 demonstrates the application of the present invention to video games and other graphics control programs requiring interactive player input. The intent of the apparatus is to adjust its own operational difficulty based upon various measurements of the player's score and response time in playing the game. The principles outlined heretofore with respect to apparatus 200 can be applied in numerous and diverse ways to achieve the desired effect in machine operation. It is also obvious that other means for applying the principles involved with the invention embodied by apparatus 200 could be devised by someone skilled in the art. The BASIC computer language was used here for the sake of clarity in describing the apparatus since it is a straightfoward language whose functions are readily understood on a line-by-line basis. However, the method of implementation is by no means limited by language and it should be evident that other languages such as ASSEMBLY, FORTRAN, PASCAL or others could be used as a means to apply the same principles. The invention is not limited to specific types of video action games. Any game utilizing moving graphic symbols under control of player input can be enhanced by the present invention.

The present invention can be used to play an education game such as the type incorporated into computer systems for the purpose of tutoring or testing individuals in various subjects on a personal basis. The apparatus shown in FIG. 20 can be used for this purpose. Currently available education programs for a computer of the type shown in FIG. 20 cover various subjects of studies such as mathematics, foreign languages and English and fields involving the arts and sciences. These routines are set up on the basis of specific levels of study. A beginning student would generally start with lesson one and gradually move his way up through the hierarchy of more difficult lessons.

There are several inherent problems with the current programs. Since not all students are at the same ability level in any given field of study, it is not always advisable to begin at level 1 with every student. However, it is often difficult to determine which lesson a student should start with. If the lesson is too simple, the result is boredom and loss of interest. If the lesson is too difficult, the result is frustration which has the same effect on the student's desire to learn.

Another problem encountered in current teaching programs is that the student is tutored and tested at a rate determined by the program alone. After the student responds to a set number of questions, the program moves on to the next section or lesson with little regard for the student's ability to handle the new material. Since attention span and concentration will differ between students, some will tend to learn more quickly than others whose learning curve is below average. Assuming the program is designed for the average student, the fast learners will again become bored, whereas the slow learners will become frustrated and the program loses its effectiveness.

The present invention avoids these problems by determining the student's ability level and rate of improvement.

The invention thus adjusts the program operation such that the level of difficulty is matched to the student's ability level in order to maintain challenge and the interest of the student. The result of overcoming the aforementioned problems is increased learning incentive and motivation for continuing the operation of the education game.

Figure 20:
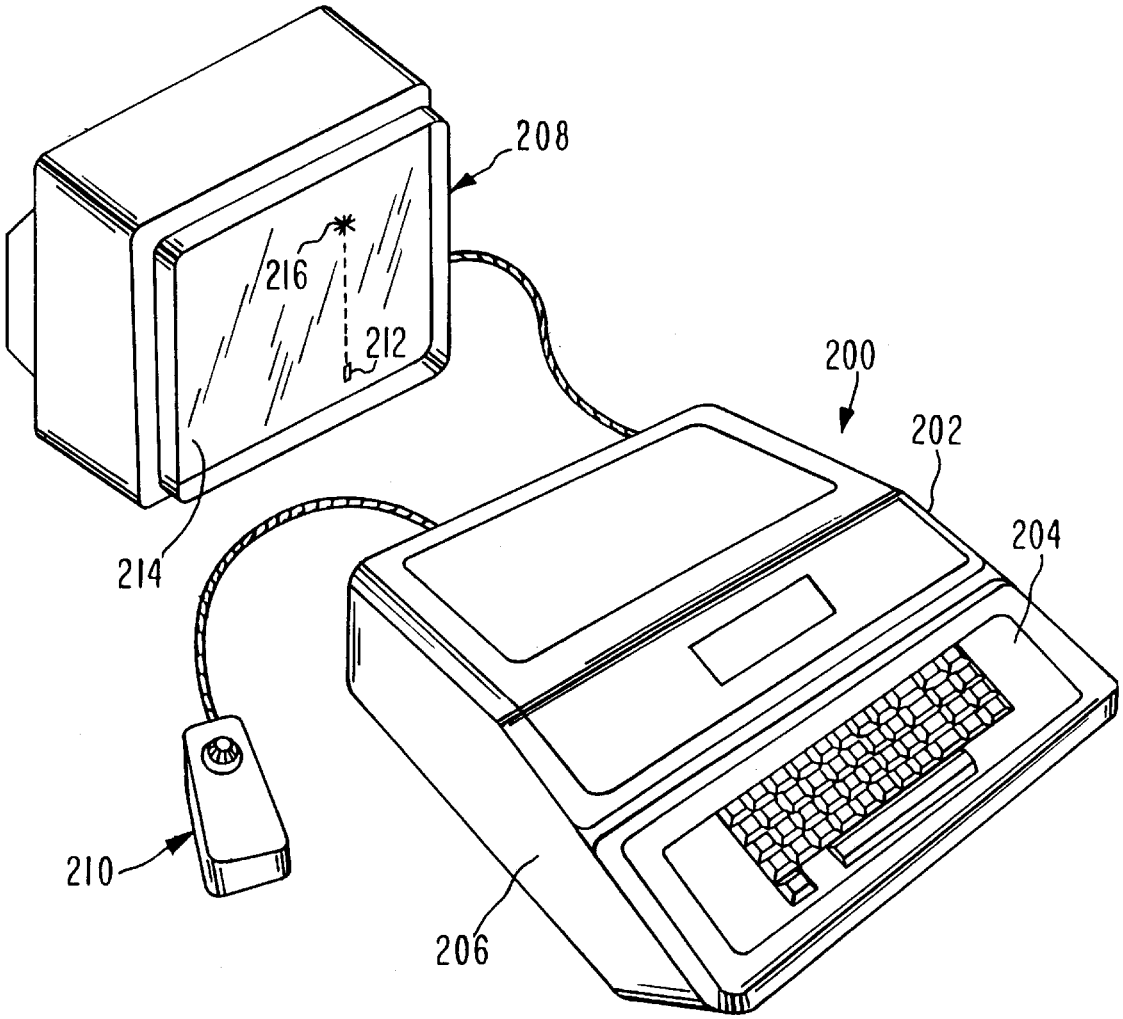

The education game of the present invention can be implemented on an Apple II Plus personal computer. As shown in FIG. 20, this machine uses a video display screen, an operating device having an actuatable control member in the form of a player operated keyboard, and a real time clock for the determination of the time of day. The system uses the BASIC computer language for programming although many other languages and computers are available which would be equally suited to implementing the concepts set forth in the present invention.

For purposes of illustration, a fundamental multiple choice vocabulary routine has been developed and will be described in reference to the invention. Its function is to test student ability based on previously studied material. The unique nature of this education game is that it creates a parameter representing the virtual grade level of the student from the ratio of correctly answered questions to the total number of questions asked. This parameter, in conjunction with the student's response time in answering questions, and the time of day during testing, determine a reward which is used to modify the line of questioning until the question difficulty level matches the ability level of the student. This ensures that the student will always be tested at his ability level to avoid the problems of boredom and frustration associated with current programs. By monitoring the aforementioned parameters, the education game can also determine when a student's ability has leveled off which may indicate a need for further study of the material being tested. In this way, the testing proceeds at a rate that is interesting and challenging for the student. The advantage of a system of this kind is that it greatly enhances student incentive. A student who is interested in and challenged by the material being presented will be more motivated to continue to operate the education game.

The operation of the education game disclosed in this embodiment is as follows. A displayed object in the form of a word is printed on the video screen along with a list of three possible choices for answers. The word difficulty is divided into 11 levels representing grades three through college in word difficulty. Each level consists of ten words of comparable difficulty. The student picks the letter corresponding to the answer he chooses to be the best definition of the given word. The routine keeps track of correct answers for use in formulating the proper internal grade level or score of the student. This grade level is further modified by the time of day factor, calendar time, and a factor representing the response time or how rapidly a student answers the questions, to form a final value of the reward level which is best suited to the student operating the game. The time of day is an important factor to consider in determining a student's motivation or ability to answer questions because he may be tired after a long day or have other things on his mind. The response time in answering questions is also a valid measure of the degree of a student's knowledge of the material being tested. Slow answers may indicate that a student is guessing and should ideally restudy the material. These combined factors are used together to determine the difficulty level of the program which most closely matches the ability level of the student.

Figure 25:
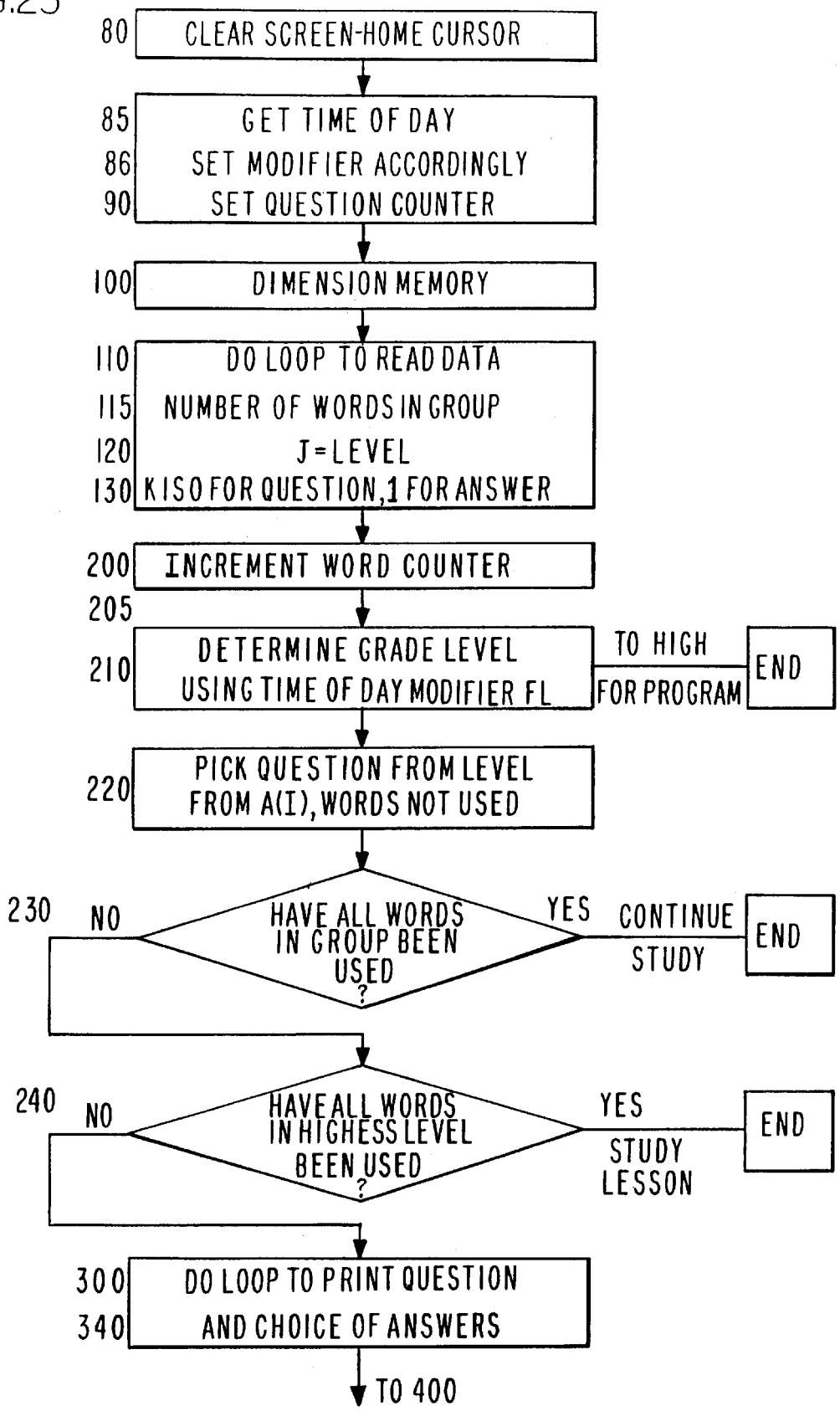
Figure 26:
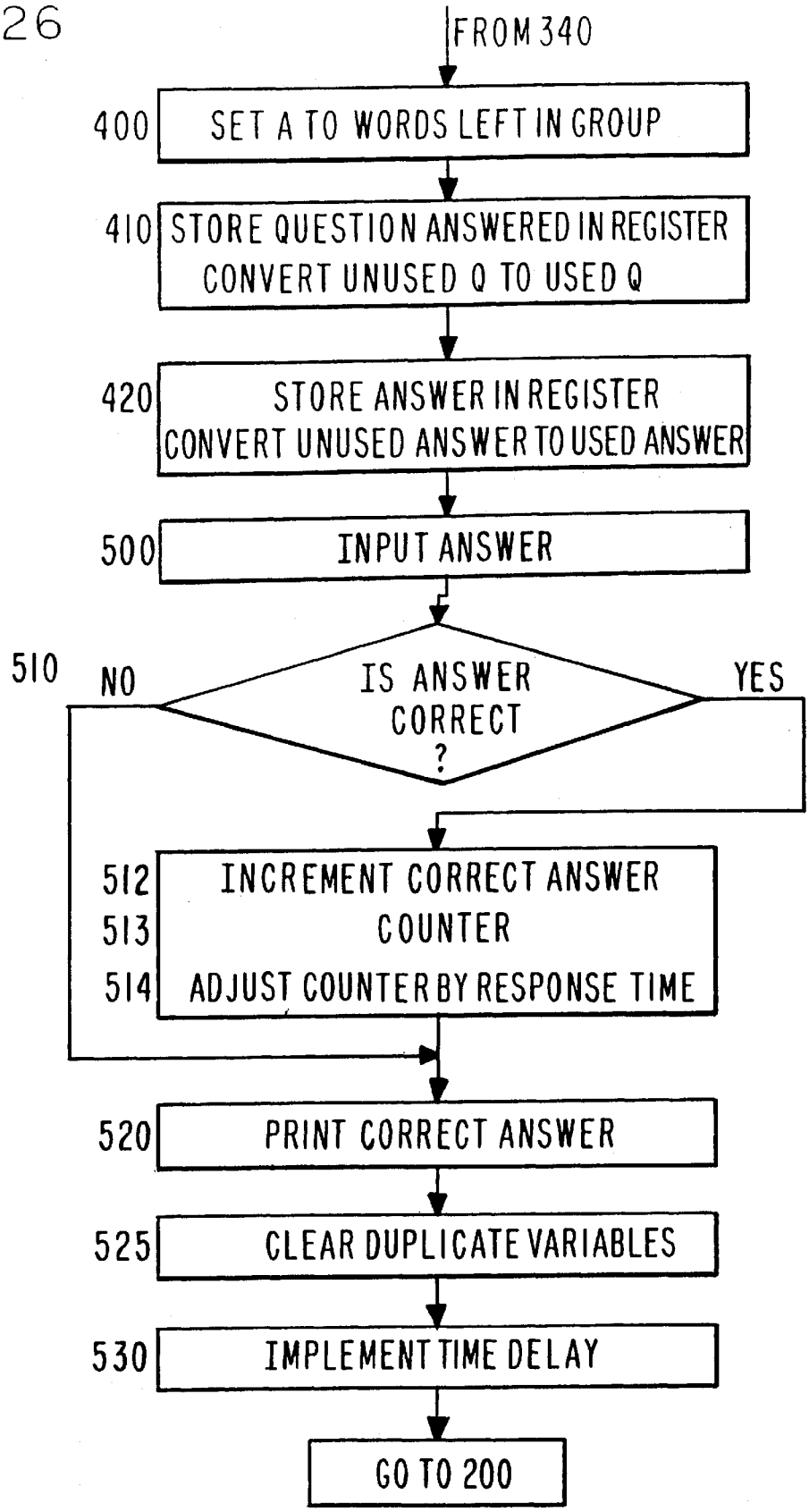

Reference is made to the flowcharts of FIGS. 25 and 26, and Table 2 which is the BASIC source listing for implementing the education game of the present invention. Lines 80–150 are for routine initialization. Line 80 clears the screen to prepare for the start of the game. Line 85 calls a subroutine which reads the time of day, where T4 represents the hours (0–23). Then, in line 86, parameters are set depending on when, during the day, the game is in operation. If the time is between 9 AM and 3 PM (normal school hours) then parameter H is set to 3, and the time of day modifier FL is set to one indicating a higher level of expected enthusiasm from the student. This serves to make the questions proportionally more challenging as will be seen later in the program. During all other hours of the day, or calendar time such as on weekends, or during summer vacation as desired and in varying degrees, the program is made slightly less challenging because of an expected lack of incentive of the student to learn during those times. In this implementation, the values H and FL will default to zero making the program easier during off hours as will be described. Line 90 sets the question counter F to 10 which moderates the effect that several consecutive right or wrong answers will have on how fast the machine adjusts to the student's ability level.

At line 100, memory is allocated for storing vocabulary words and their associated answers. Lines 110 through 150 actually load the word into that memory. Line 200 begins the program body. The question counter F is incremented in preparation for presenting the next question. The grade level I is determined in line 210. This is an integer number derived from the number of correctly answered questions divided by the total number of questions answered. This fraction, which has a range from 0 to 1.1 is multiplied by 10 to give the 11 grade levels.

It is evident that a higher number of correctly answered questions results in a higher grade operating level and a lower number of correctly answered questions results in a lower grade operating level. It can also be seen in line 210 that if the time of day modifier FL is set to 1, as was explained previously, parameter I will be increased over what it would be if I were 0. The other change made to grade level I occurs in lines 502 and 503 when the promptness of answering questions is considered. These are the factors considered by this program for adjusting the question difficulty to match the ability level of each particular student. Line 220 randomly picks questions out of the list at the present grade level defined by I which was derived as explained. The term A(I) represents the number of unasked questions in grade level I. In this way, the machine can keep track of what questions have been asked and repeat the same word.

Line 230 is a check to determine if all words in the present grade level have been used. If so, this means the student's average ability level has remained constant through all ten available words in that level and the routine exits to inform the student to study the appropriate lesson in preparation for higher grade levels.

Line 240 determines if all words at the highest level have been used. In this case, the student has surpassed this level and is now beyond the capabilities designed into this program. The routine must then end. If both tests of lines 230 and 240 are negative, the routine enters a loop in lines 300–340 which prints the next question on the screen.

Lines 400–430 temporarily store the question just asked and replace its vacant position with a fresh question from memory. Then the number of available questions is decremented by 1. In line 450, the time in seconds is retrieved by subroutine 1000 immediately after a test question appears on the screen. In line 500, the answer is input as a letter A, B, or C, and subroutine 1000 is again called to determine the time in seconds. Then line 510 checks to see if the chosen answer is the correct one. If so, the correct answer counter is incremented by one in line 512. If not, the control is passed on to 520 for printing of the correct answer. In line 513, the student can be rewarded for answering quickly. If the correct answer is chosen in less than 5 seconds, it is worth 2 correct answers as shown by the additional increment of counter H. However, in line 514, if it takes the student over 10 seconds to choose the correct answer, it is counted as wrong anyway as shown by decrementing H back to its original value. This is the means used by the program for modifying the operating level based on player response time to the questions being asked. Naturally, the faster a student is able to answer a question, the better he knows the material, and the sooner the program will promote him to a higher learning level. After the response time changes, control is passed to line 520 for printing of the correct answer for the benefit of the student.

At this point the routine is reinitialized to delete duplicate string variables in preparation for the next question. A time delay loop is used in line 530 to allow a moment for the student to view the question and the printed answer before the screen is cleared and the next question appears.

The unique nature of this education program is that it self-adjusts to the student's ability level. Also, it can determined and adjust to the rate at which a student is progressing through the material. Any education program which monitors and adjusts automatically and continually for ability level and rate of student performance is within the scope of this invention. Thus, the invention may be applied to various types of computer education games involving different subjects, larger data bases, or a variety of teaching methods. Additional programs utilizing the concept of this invention can include, for example, a mathematics exercise routine which determines a student's ability to work problems. The program could modify the size, sign and quantity of numbers in an equation as well as the complexity of mathematical operations involved in its solution. A word association program could be developed in which a student may use words, phrases or sentences that describe or are similar to the given word or question. The program then rates student ability by how extensively the given word is described by the student and uses that knowledge to make the words easier or harder depending on the student's performance. Each of these programs encourages student incentive to learn by adjusting their operational difficulty to a level that the student is challenged by but does not have excessive difficulty in mastering. In each case, the student is led to believe he is progressing even if his level is below normal or if it drops from one question to the next. Unaware of the changes occurring in the machine, student incentive to play is therefore maintained resulting in more hours of operation in which the student has the opportunity to learn.

Details have been disclosed to illustrate the invention in a preferred embodiment of which adaptations and modifications within the spirit and scope of the invention will occur to those skilled in the art. The scope of the invention is limited only by the following claims.

TABLE 1

```
30 REM SHOT MODIFIER =HITS(OLD; / SHOTS FIRED(OLD) +
CONSTANT /SHOTS FIRED(NEW) – SQU(CONSTANT
31 REM HIT MODIFIER =HITS / SHOTS FIRED * CONSTANT
40 HOME
```

TABLE 1-continued

```
41 REM CLEAR SCREEN
42 GOSUB 1000
45 R1 = 7
46 IF (64 < 6 AND T4 > 4) OR (T4 < 14 AND T4 > 10) THEN
R1 = 18
47 REM TIME OF DAY MODIFICATION
50 CH = 186:A1 = 2000:F = 9
51 REM CH=CHARACTER FIRED FROM BASE.
A1 = LINE BASE TRAVELS ON
52 REM F=AVERAGE FIRE RATE
60 X3 = 1152:X(1,1) = O:X(1,2) = O:X4 = 0:XY = 0:Y = 0
61 REM X3=LEFT LIMIT OF SCREEN
62 REM THESE VARIABLES FOR MAKING VERTICAL LINE ON
SCREEN:X(1,1)–128 INCREMENTS,X(1,2)–40 INCREMENTS
63 REM X4–TIME TARGET IN 1 LINE, Y–COUNTER FOR
3 SECTIONS OF SCREEN –,XY–COUNTER FOR 7 SUBSECTIONS
OF SCREEN
70 D1 = 1152
71 REM D1=LIMIT FOR TARGET
80 XA = 976:SB = 1189:XC = 1152
81 REM XA=LENGTH TO TOP OF SCREEN:XB=RIGHT LIMIT OF
SCREEN:XC=LEFT LIMIT OF SCREEN
100 D = 1152 + INT ( RND (1) * 39) + 1
101 REM D=STARTING POSITION OF TARGET
120 W = PDL (0) / 6.53846154:F1 = 0
121 REM SET FLAG F1 IF BASE HAS MOVED
127 TE = W:M1 = 0
128 REM TE=TEMPORARY LOCATION OF BASE TO COAMPARE
IF BASE HAS MOVED ON NEXT MOVE,CLEAR M1–MODIFIER
OF MOVEMENT OF TARGET
130 C = C + 1
131 REM C=NUMBER OF BULLET IN BUFFER BY NINE'S
H=MODIFIER
OF BUFFER ACCORDING TO SCORE,H IS DERIVED AT 600
150 POKE D,160
151 REM D=TARGET LOCATION
152 REM 160 CLEARS TARGET LOCATION
160 GOSUB 500
161 REM 500–FIGURE TARGET LOCATION
170 POKE D,163
171 REM POKE TARGET(#) ON SCREEN
180 FOR T = 1 TO (30 – h / 3): NEXT
181 REM TIME DELAY TO SEE SYMBOLS ON SCREEN
190 POKE A1,160:A1 = W + 2000: POKE A1,32
191 REM CLEAR BASE, CALCULATE NEW POSITION OF BASE,
POKE ON BASE
200 IF PEEK ( – 16287( < 128 THEN 120
201 REM CHECK IF BUTTON ON PADDLE TO FIRE SHOT PUSHED
210 IF C < (9 + H / 10) THEN 120
211 REM IF BUFFER FOR FIRING IS LARGE ENOUGH TO FIRE
220 F = F + 1
221 REM F=NUMBER OF SHOTS FIRED
225 C = C – 9 – H / 10
226 REM DECREMENT BUFFER AFTER FIRING
230 H = R1 + 81 / (F – FT + 9)
231 REM CALCULATE FIRE MODIFIER
232 IF H < 0 THEN H = 0
240 GOSUB 300
241 REM FIRE SHOT
250 CH = 160: GOSUB 300
251 REM CLEAR SHOT
255 CH = 186
256 REM RESET CHARACTER TO BULLET
260 IF INT (W) + 2000 = INT D) + X1 – 1123 THEN GOTO 800
261 REM CHECK IF TARGET WAS HIT
270 GOTO 120
271 REM END OF CONTROL LOOP
300 A = 2000 + W
301 REM A=POSITION OF BASE
302 REM BEGINNING OF FIRE ROUTINE
310 FOR Z = 0 TO 80 STEP 40
311 REM 3 SECTION OF SCREEN
320 Q = A – Z
330 GOSUB 400
331 REM POKE ON BULLET
340 NEXT
345 POKE A,160; VTAB 1: PRINT "          ": VTAB 1: PRINT
  INT (S)
346 REM CLEAR BASE LOCATION AFTER FIRING PRINT SCORE
```

TABLE 1-continued

```
350 RETURN
400 FOR X = 1 TO 8
401 REM POKE BULLET IN 8 PIECE SECTIONS
410 POKE Q,CH: POKE A,32
411 REM POKE BULLET SECTION. POKE ON BASE
420 Q = Q − 128
421 REM 128 POINTS TILL NEXT LINE UP
430 NEXT
440 RETURN
500 GOSUB 800
501 REM CALCULATE TARGET LOCATIONS AND LIMITS OF
TARGET MOVEMENT
502 IF F1 AND ( ABS (INT (W) + 128 + 2000 − D − S1)) < = 2
THEN GOSUB 700
503 REM CALCULATE M−MODIFIER FOR TARGET MOVEMENT
IF TARGET HAS MOVED AND TARGET WITHIN 2 VERTICAL
COLUMNS OF BASE
504 IF F1 AND ( INT (W) + 2000 = IND (D) + X1 − 129) THEN
555
505 IF C < 1.8 * (9 + H / 3) OR (H < 30) THEN 530
506 REM IF LESS THAN 2 STORED BULLETS THEN LET TARGET
STAND STILL
510 D = D + ( INT ( RND (1) * 2) * 2 − 1) * (1 + (H > 30)) +
M1
511 REM TARGETT CAN MOVE ONLY LEFT OR RIGHT
520 GOTO 540
530 D = D + INT (RND (1) * 3) − 1 + M1
531 REM TARGET CAN MOVE LEFT, RIGHT STAY SHERE IT IS
540 IF D > X2 THEN D = X2 − INT ( RND (1) * 2 + 1)
550 IF D < X3 THEN D = X3 + INT ( RND (1) * 2 + 1)
551 REM PARAMETERS ON LIMITS OF SCREEN MEM
555 F1 = 0: REM CLEAR MOVEMENT FLAG
560 RETURN
600 S = S + 1
601 REM S=SHOTS THAT HIT
610 H = (S / F) *90
611 REM MODIFY BUFFER IN RATIO OF SHOTS HIT TO SHOTS
FIRED
TIMES CONSTANT
615 VTAB 1: PRINT "    ": VTAB 1: PRINT INT (S)
616 REM PRINT SCORE
617 K3 = 1: IF (T4 < 18 AND T4 > 18) OR (T4 < 14 AND T4 > 10)
THEN K3 = 1.5
618 R1 = H * K3
620 FT = F: GOTO 60
700 M1 = SGN (H − 300 * SGN ( INT (W) + 128 + 2000 − D −
X1):( ABS (H − 30) > ( RND (1) * 154 + 5))
710 RETURN
800 D = D1 + D − X3 + X(1,1) + X(1,2)
801 REM FIND TARGET LOCATION IF TARGET MOVED DOWN
LINE
810 X1 = XA − X(1,1) − X(1,2):X2 = XB + X(1,1) +
X(1,2):X3 = XC + X(1,1) + X(1,2)
811 REM CALCULATE SCREEN LIMITS
820 X4 = X4 + 1: IF X4 < (9 − INT (H / 15)) THEN RETURN
821 REM CALCULATE IF TARGETT STILL ON SAME LINE
830 X4 = 0
831 REM RESET COUNTER IF NOT
840 XY = XY + 1: IF XY > = 7 THEN XY = :Y = Y + 1
841 REM COUNT OUT 7 SUBSECTIONS IN SCREEN
842 REM IF FULL THEN MOVE ONTO NEXT SCREEN LOCATION
850 IF Y = 3 THEN PRINT "END": END
851 REM IF TARGET AT BOTTOM OF SCREEN THEN END
860 X(1,1) = 128 * XY:X(1,2) = 40 * Y
861 REM SECTIONS OF SCREEN
870 RETURN
1000 REM TIME OF DAY SUBROUTINE
1010 IN# 1: PR# 1
1020 PRINT "#"
1030 INPUT TI1,TI2,TI3,TI4,TI,TI6
1040 IN# 0: PR# 0
1050 RETURN
```

TABLE 2

```
80 HOME
85 GOSUB 1000
86 IF T4 < 15 AND T4 > 9 THEN H = 3:FL = 1
87 REM TIME OF DAY MODIFIER
90 F = 10
91 REM F=COUNTER FOR NUMBER OF WORDS USED
100 DIM A$(10,9,1): DIM A(10)
101 REM READ WORDS AND ANSWERS INTO ARRAY
110 FOR I = 0 TO 10
115 A(I) = 9
116 REM A(1)=NUMBER OF WORDS NOT USED ON LEVEL
120 FOR J = 0 TO 9
130 FOR K = 0 TO 1
140 READ A$(I,J,K)
141 REM I=GRADE LEVELS.J=NUMBER OF WORDS IN EACH
LEVEL,K=(O=WORD, 1=ANSWER)
150 NEXT K,J,I
200 F = F + 1
201 REM F=NUMBER OF WORDS USED
210 I = INT (H / F * 10) * (1 + FL * .5): IF i > 10
THEN I = 10
211 REM TIME OF DAY MODIFIER
220 J = INT ( RND (1) * A(I))
221 REM CALCULATE LEVEL AND WORD SUBSCRIPTS
230 IF A(I) = 0 AND I < 10 THEN PRINT "STUDY THE
NEXT LESSON": END
231 REM CHECK IF ALL WORDS ON LEVEL HAVE BEEN USED
240 IF A(I) = 0 AND I = 10 THEN PRINT "THE NEXT
LESSON": END
241 REM CHECK IF WORDS HAVE BEEN USED UP ON HIGHEST
LEVEL, IF SO END
300 FOR Y = 1 TO ( LEN (A$(I,J,0)))
301 REM PRINT WORD AND POSSIBLE ANSWERS
305 A$ = A$(I,J,0)
310 P$ = MID$ (A$,Y,1)
320 IF P$ = "−" THEN P$ = CHR$ (13)
321 REM CHECK EACH LETTER TO FORMAT PRINTING
330 PRINT P$;
340 NEXT Y: PRINT
400 A = A(I)
401 REM TRANSFER WORD CHOSEN TO OUTSIDE OF
SUBSCRIPT RANGE WITH WORD NOT CHOSEN
402 REM SO THAT SAME WORD IS NOT CHOSEN TWICE
410 T$ = A$(I,J,0):A$(I,J,0) = A$(I,A,0):A$(I,A,0) = T$
420 T$ = A$(I,J,1):A$(I,J,1) = A$(I,A,1):A$(I,A,1) = T$
430 A(I) = A(I) − 1
431 REM DECREMENT SUBSCRIPT RANGE
450 GOSUB 1000
460 TF = T7
500 PRINT : INPUT "ANSWER: ";C$
501 REM INPUT ANSWER
502 GOSUB 1000:TF = T7 − TF
510 IF C$ < > LEFT$ (A$(I,A,1),1) GOTO 520
512 H = H + 1
513 IF TF < 5 AND TF > 0 THEN H = H + 1
514 IF TF > 10 OR TF < = 0 THEN H = H − 1
520 PRINT "ANSWER IS: "A$(I,A,1)
521 REM PRINT CORRECT ANSWER
525 Q = FRE (0): REM GARBAGE COLLECTION OF STRINGS
530 FOR D = 1 TO 3000: NEXT : HOME : GOTO 200
531 REM TIME DELAY TO SEE ANSWER. CLEAR SCREEN. END
OF LOOP
600 DATA NOTE- A.GOOD GRADE- B.SHORT LETTER-
C.FUNNY JOKE.B.SHORT LETTER
601 DATA SNACK- A. HIDING PLACE- B.SMALL MEAL-
C.LOW STOOL.B.SMALL MEAL.CLUB- A.DEEP CUT- B.HEAVY
STICK- C.GOOD DEED.B.HEAVY STICK
602 DATA EXPLAIN- A. MAKE CLEAR- B.DISCOVER- C.MIX
UP. A.MAKE CLEAR,CHILLY- A. QUITE WARM- B.VERY HOT-
C.RATHER COLD.C.RATHER COLD
603 DATA TRIP- A.STUMBLE- B.CATCH-
C.LAUGH, A.STUMBLE
604 DATA MAGNET- A.CATCHES BIRDS- B.ATTRACTS IRON-
C.FIXES GLASS,B.ATTRACTS IRON,PLAIN-
A.WOODEN- B.FUNNY- C.SIMPLE,C.SIMPLE
605 DATA GLAD- A.HAPPY- B.SAD- C.ANGRY,A.HAPPY,LEAP-
A.WALK- B.SEE- C.JUMP,C.JUMP,LOCATE- A.CUT OFF-
B.BRING ABOUT- C.FIND,C.FIND
606 DATA RETIRE- A.EXCHANGE FOR SOMETHING- B.GO
```

TABLE 2-continued

BACK AGAIN- C.STOP WORKING.C.STOP WORKING,SELF CONFIDENCE- A.BEING SHY- B.BELIEF IN YOURSELF- C.SELFISHNESS,B.BELIEF IN YOURSELF,ABILITY= A.LEARNING- B.SKILL- C.HOPE,B.SKILL
607 DATA IMAGINE A.TRY TO EXPLAIN- B.PUT IN ORDER- C.PICTURE IN ONE'S MIND,C.PICTURE IN ONE'S MIND, SAMENESS- A.SLIGHT DIFFERENCE- B.SOMETHING WITHOUT PURPOSE- C.BEING ALIKE, C.BEING ALIKE
608 DATA TENDER- A.SOFT- B.CLEAR- C.THIN,A.SOFT, BASHFUL- A. SHY- B.BOLD- C.HARMFUL,A.SHY.LENGTHEN- A.MAKE LONGER- B.MAKE BELIEVE- C.SHRINK, A.MAKE LONGER
609 DATA SIGNATURE- A.YOUR NAME IN WRITING- B.STAMP OF APPROVAL- C.HEAVY TRUCK,A.YOUR NAME IN WRITING, VICTORIOUS- A.HAS WON- B.HAS FOUGHT- C.HAS WATCHED, A.HAS WON,PROSPEROUS- A.HAPPY- B.SUCCESSFUL- C.POOR,B.SUCCESSFUL
610 DATA PARALYZE- A.ACT SLOWLY- B.MAKE POWERLESS- C.SPEED UP,B.MAKE POWERLESS.PLEDGE- A.PROMISE- B.REQUEST- C.FAITH,A.PROMISE,ACCOUNT- A. SOMETHING EXTRA- B.SHORT TERM- C.BUSINESS RECORD, C.BUSINESS RECORD
611 DATA DEADLINE- A.END OF A RACE- B.TIME LIMIT- C.FISHING EQUIPMENT.B.TIME LIMIT,PACE- A.PRICE- B.SILENCE- C.RATE,C.RATE,REASONABLENESS- A.FOOLISH FOR NO REASON- B.MAKING GOOD SENSE- C.ABILITY TO WORK,B.MAKING GOOD SENSE
612 DATA ROUSE- A.WAKE UP- B.SOAK WITH WATER- C.SPEAK QUIETLY,A.WAKE UP, CONFUSED- A.SET APART- B.MIXED UP- C.ACTING NATURAL.B.MIXED UP
613 DATA PART- A. JOIN- B.SEEK- C.SEPARATE,C.SEPARATE,FAULTLESS- A.UNTRUE- B.PERFECT- C.SATISFACTORY,B.PERFECT,STUPIDITY- A.LACK OF INTELLIGENCE- B.SUDDEN HUNGER- C.WEAKENED CONDITION,A.LACK OF INTELLIGENCE
614 DATA PIRACY- A.BAD STORM- B. ROBBERY AT SEA- C. TYPE OF BANKING,B.ROBBERY AT SEA, POSE- A.AGREE- B.PROTECT- C.PRETEND,C.PRETEND, HUMID- A.DAMP- B.COOL- C.BREEZY,A.DAMP
615 DATA CONCERN- A.WORRY- B.COURAGE- C.REGRET,A.WORRY,TRANSFORM- A.MAKE LARGER- B. CHANGE- C.HEAL.B.CHANGE,ACCORD- A.ARGUMENT- B.ACTION DELAYED- C.AGREEMENT,C.AGREEMENT
616 DATA SPRIG- A.HEAVY FOG- B.SMALL BRANCH- C.GENTLE BREEZE,B.SMALL BRANCH, AMPUTATE- A.CUT OFF LIMBS- B.DRIVE SWIFTLY- C.PAY DEBTS,A.CUT OFF LIMBS
617 DATA CODDLE- A.TREAT TENDERLY- B.HANDLE TOUGHLY- C.SPEAK HONESTLY,A.TREAT TENDERLY, OMIT- A.LEAVE OUT- B.CHANGE SLIGHTLY- C.HIDE FROM VIEW,A.LEAVE OUT,CONGREGATE- A.ASSEMBLE- B.DISCOVER- C.SORT OUT,A.ASSEMBLE
618 DATA EXAMINATION- A.INVESTIGATION- B.LONG REPORT- C.POLITICAL MEETING,A.INVESTIGATION,DEPOSE- A.ELECT A LEADER- B.PUT OUT OF OFFICE- C.ORGANIZE A GROUP.B.PUT OUT OF OFFICE
619 DATA TEMPO- A.MUSICAL INSTRUMENT- B.USUAL RHYTHM- C.PAINTING PROCESS,B.USUAL RHYTHM,HANDICAP- A.PRIZE AWARDED- B.FINAL SCORE- C.ADDED HINDRANCE,C.ADDED HINDRANCE
620 DATA IMPROBABLE- A.HARD TO ENTER- B. NOT LIKELY- C.QUICK TO ACT.B.NOT LIKELY,FORFEIT- A.NAG AT CONSTANTLY- B.LOSE AS A PENALTY- C.BRING TO A SUDDEN HALT.B.LOSE AS A PENALTY
621 DATA BICKER- A.QUARREL- B.DESTROY- C.FEEL ASHAMED,A.QUARREL,UPHOLD- A.DISPLAY- B.PUT ASIDE- C.SUPPORT,C.SUPPORT,ISOLATE- A.REDUCE PRESSURE- B.BLOW UP- C.PLACE APART,C.PLACE APART
622 DATA MULISH- A.STUBBORN- B.NOISY- C.THOUGHTFUL,A.STUBBORN,INEDIBLE- A.SURE TO HAPPEN- B.UNFIT TO EAT- C.NOT EXACT,B.UNFIT TO EAT, HOMAGE- A.HONOR- B.PLACE TO REST- C.LOVE OF POWER,A.HONOR
623 DATA UTILITY- A.CLEANLINESS- B.DISAPPOINTMENT- C. USEFULLNESS,C.USEFULLNESS,BELATED-A.DELAYED- B.UNIMPORTANT- C.LONELY,A.DELAYED,PICKLE- A.PRESERVE- B.CUT UP- C.FRY SLOWLY,A.PRESERVE
624 DATA RELUCTANT- A.AFRAID- B.CURIOUS- C.UNWILLING,C.UNWILLING,HYPOCRATE- A.ALLY- B.PRETENDER- C.PATIENT,B.PRETENDER,PEN NAME- A.ASSUMED NAME- B.BOOK TITLE- C.TRADEMARK,A.ASSUMED NAME
625 DATA JUBILANT- A.WISE- B.REJOICING- C.BRILLIANT,B.RJOICING,COMA A.UNCONSCIOUSNESS- B.SERIOUS INJURY- C.MUSCULAR TWITCH,A.UNCONSCIOUSNESS,CLIENT- A.OPPONENT- B.CUSTOMER- C.PARTNER,B.CUSTOMER
626 DATA MISINTERPRET- A.DISBELIEVE- B.TREAT BADLY- C.MISUNDERSTAND,C.MISUNDERSTAND,NUCLEUS- A.UNKNOWN QUALITY- B.CONTRAL PART- C.FERTILE AREA,B.CENTRAL PART,PREDICAMENT- A.BAD SITUATION- B.HEALING LOTION- C.EXPECTED RESULT,A.BAD SITUATION
627 DATA CONSUMER- A.OWNER- B.ARRANGER- C.USER,C.USER,RELIC- A.KEEPSAKE- B.STRATEGY- C.VICTORY,A.KEEPSAKE,CIRCULATE- A.PASS AROUND- B.PUSH- C. CONNECT,A.PASS AROUND
628 DATA AMNESIA- A.BLOOD DISEASE- B.INSANITY- C.LOSS OF MEMORY,C.LOSS OF MEMORY,REVISE- A.CHANGE- B.RECOLLECT- C.CRITICIZE,A.CHANGE,BUCCANEER- A.PIRATE- B.SOLDIER- C.COWBOY,A.PIRATE,EXALT- A. CRITICIZE- B.LOVE- C.GLORIFY,C.GLORIFY
629 DATA SOMBER- A.TINTED- B.GLAMOROUS- C.DARK,C.DARK,ELOQUENCE- A.LOGICAL ARRANGEMENT- B.FINE SPEAKING- C.FALSE APPEAL,B.FINE SPEAKING,SQUANDER- A.MOVE WITHOUT DIRECTION- B.INVEST- C.SPEND FOOLISHLY,C.SPEND FOOLISHLY
630 DATA ENDOWMENT- A.GIFT TO PROVIDE INCOME- B.BUILDING CONTRACT- C.LARGE DOWNPAYMENT,A.GIFT TO PROVIDE INCOME,CURDLE- A.THICKEN- B.DULL- C.BLEND,A.THICKEN,ASPIRE- A.CUT OFF- B.OPTIMISTIC- C.DESIRE EARNESTLY,C.DESIRE EARNESTLY
631 DATA RIVALRY- A.COMPANIONSHIP- B.DUET- C.CONTEST,C.CONTEST,PERVERSE- A.INTRODUCTORY- B.CARELESS- C.PERSISTENTLY WRONG,C.PERSISTENTLY WRONG, VANQUISH- A.TOLERATES- B.DISAPPEAR- C.CONQUER,C.CONQUER
632 DATA SCANDALIZE- A.OFFEND BY WRONG DOING- B.ARGUE INSISTENTLY- C.PERSUADE EFFECTIVELY,A.OFFEND BY WRONG DOING,HERETIC- A.CRUEL SAVAGE- B.OPPONENT OF ACCEPTED BELIEF- C.ADVOCATE OF COURT ACTION,B.OPPONENT OF ACCEPTED BELIEF
634 DATA RELIABILITY- A. ATTENTION- B. ENDURANCE- C.TRUSTWORTHINESS,C.TRUSTWORTHINESS, COAX- A.BURY- B.PUNISH- C.PERSUADE,C.PERSUADE, EVACUATION- A. TERROR- B.WITHDRAWAL- C.ACCUMULATION,B.WITHDRAWAL
635 DATA DETRACT- A.MAKE SHORTER- B.TAKE AWAY- C.ACHANGE ABRUPTLY,B.TAKE AWAY
636 DATA PREVALENT- A.WIDESPREAD- B.PREJUDICE- C.ILLEAGAL,A.WIDESPREAD, PORTLY- A.WEARY- B.STOUT- C.CHEERFUL,B.STOUT,DELIBERATE- A.CONFINE SECRETLY- B.ARGUEBITTERLY- C.CONSIDER CAREFULLY,C.CONSIDER CAREFULLY
637 DATA PERJURE- A.STEAL AWAY- B.SWEAR FALSELY- C.INJURE SLIGHTLY,B.SWEAR FALSELY,DIABOLIC- A.FLOOMY- B.DEVILISH- C.MEDICINAL,B.DEVILISH,TRIVIAL- A.UNIMPORTANT- B.INEXPENSIVE- C. EXHAUSTING,A.UNIMPORTANT
638 DATA DEFECIT- A.SHORTAGE- B.CREDIT- C.PAYMENT,A.SHORTAGE,EMANCIPATION- A. POOR HEALTH- B.SETTING FREE- C.FORMAL DISCOURSE,B.SETTING FREE,BOORISH- A.SAVAGE- B.CRUEL- C.RUDE,C.RUDE
639 DATA ZENITH- A.RAY OF LIGHT- B.HIGHEST POINT- C.BLUISH GEM,B.HIGHEST POINT
640 DATA STRINGENT- A.LENGTHY- B.STRICT- C.LAX,B.STRICT,ALLEVIATE- A.POSTPONE- B.AGGRAVATE- C.ALLAY,C.ALLAY, SEQUESTER- A.ISOLATE- B.REFUSE- C.ESSENTIAL,A.ISOLATE,INTRINSIC- A.DECORATIVE- B.SPACIOUS- C.ESSENTIAL,C.ESSENTIAL

TABLE 2-continued

```
650 DATA RUMINATE- A.PONDER- B.ALLOCATE-
C.PROVE,A.PONDER,GAMBIT- A.FAILING HEALTH-
B.OPENING MOVE- C.AMUSING CAPER,B.OPENING
MOVE,ABROGATE- A.DESIRE- B.ABOLISH-
C.REFINANCE,B.ABOLISH
651 DATA MERETRICIOUS- A.DECEPTIVELY ALLURING-
B.FOUL TEMPERED- C.UNJUSTLY EARNED,A.DECEPTIVELY
ALLURING,RECAPITULATE- A.APOLOGIZE- B.ANALGESIC-
C.SUMMARIZE,C.SUMMARIZE
652 DATA ANCILLARY- A.LEGALLY ENTITLED-
B.SUBORDINATE- C.PHENOMENAL,B.SUBORDINATE
1000 REM TIME OF DAY SUBROUTINE
1010 IN# 1: PR# 1: PRINT "#"
1020 INPUT T1,T2,T3,T4,T5,T6
1030 PR# 0: IN# 0
1040 T7 = T5 * 60 + T6
1050 RETURN
```

What is claimed is:

1. A game apparatus playable by one or more players which enhances the incentive of a player to continue to operate the apparatus comprising:

an operable symbol displaying device for displaying any one or more of a number of different symbols, said displaying device being difficult to operate;

a player actuated operating device for use by the player in the operation of the displaying device;

an accounting device coupled with the displaying device for providing an accounting of the game playing effectiveness of a player during the operation of the operating device; and a processing device responsive to the operation of the displaying, accounting, and operating devices, said processing device having means for rendering the displaying device difficult to operate, said means automatically changing the difficulty of operation of the displaying device as a function of the game playing effectiveness of the player before a displayed score is calculated without communicating to the player any change in the difficulty of operation of the displaying device while play is in progress, there being an automatic increase in the difficulty of operation of the displaying device in response to an increase in the game playing effectiveness of the player or a decrease in the difficulty of operation of the displaying device in response to a decrease in the game playing effectiveness of the player to thereby provide incentive to continue the operation of the displaying device.

2. Apparatus for playing a game playable by one or more players which enhances the incentive of a player to continue to play the game by operating the apparatus until the game is over and a final score is reached, the apparatus comprising:

an operable symbol displaying device for displaying any one or more of a number of different symbols, said displaying device being difficult to operate;

a player actuated operating device for use by the player in the operation of the displaying device;

an accounting device coupled with the displaying device for providing an accounting of the game playing affectiveness of a player during the operation of the operating device; and a processing device responsive to the operation of the displaying, accounting, and operating devices, said processing device having means for rendering the displaying device difficult to operate, said means automatically changing the difficulty of operation of the displaying device as a function of the game playing effectiveness of the player before the final score is calculated without communicating to the player any change in the difficulty of operation of the displaying device while play is in progress, there being an automatic increase in the difficulty of operation of the displaying device while play is in progress in response to an increase in the game playing effectiveness of the player or a decrease in the difficulty of operation of the displaying device while play is in progress in response to a decrease in the game playing effectiveness of the player to thereby provide incentive to continue the operation of the displaying device.

3. Apparatus for playing a game which enhances the incentive of a player to continue to play the game, a final score being awarded at the end of the game, the apparatus comprising:

an operable symbol displaying device for displaying at least one symbol, the displaying device being difficult to operate;

a player actuated operating device for use by the player to operate the displaying device;

an accounting device coupled with the displaying device for providing an accounting of the game playing effectiveness of the player while the player operates the operating device; and a processing device responsive to the operation of the displaying, accounting, and operating devices, the processing device having means for rendering the displaying device difficult to operate, said means automatically changing the difficulty of operation of the displaying device as a function of the game playing effectiveness of the player before the final score is calculated and without communicating to the player any change in the difficulty of operation of the displaying device while play is in progress, there being an automatic increase in the difficulty of operating the displaying device while play is in progress in response to an increase in the game playing effectiveness of the player or a decrease in the difficulty of operating the displaying device while play is in progress in response to a decrease in the game playing effectiveness of the player to thereby provide incentive for the player to continue the operation of the displaying device.

4. Apparatus as set forth in claims 1, 2 or 3, wherein said processing device includes means responsive to the operation of the displaying, accounting and operating devices for proportionally changing the operation of the displaying device to increase or decrease the difficulty of operation of the displaying device as a function of a variable parameter.

5. Apparatus as set forth in claims 1, 2 or 3, wherein said displaying device includes a number of side-by-side rotatable reels, said reels having a number of symbol mounted on their peripheries, said accounting device having a token receiving and payout device, said operating device having an actuatable control member for causing rotation of the reels, said processing device having means responsive to operation of the displaying, accounting and operating devices for changing the operation of the displaying device to increase or decrease the difficulty of operation of the displaying device.

6. Apparatus as set forth in claims 1, 2 or 3, wherein said displaying device includes a support structure, said support structure having at least one symbol which is mechanically movable relative to a predetermined reference point and mounted to the support structure, said accounting device having a reward payment device, said operating device having an actuatable control member for causing movement of the symbol, said processing device having means responsive to the operation of the displaying, accounting and operating devices for changing the operation of the displaying device to increase or decrease the difficulty of operation of the displaying device.

7. Apparatus as set forth in claims 1, 2 or 3, wherein said displaying means includes a support structure, said support structure having at least one symbol mechanically movable relative to a predetermined reference point mounted on the support structure, said operating means including a device which fires a projectile at said symbol under control of the user, said accounting means having means to count the number of actual and ideal hits of said projectile upon said symbol, said processing means including means for determining an ideal operating level of the apparatus based on a comparison of the counts generated by said accounting means, and means for determining an end of the game and displaying the final score.

* * * * *